US012044027B2

(12) United States Patent
Singh et al.

(10) Patent No.: US 12,044,027 B2
(45) Date of Patent: Jul. 23, 2024

(54) DUAL MODE TENT

(71) Applicant: Sea to Summit Pty Ltd, Rivervale (AU)

(72) Inventors: Paramjeet Singh, Rivervale (AU); Roland Tyson, Rivervale (AU)

(73) Assignee: Sea to Summit Pty Ltd, Rivervale (AU)

( * ) Notice: Subject to any disclaimer, the term of this patent is extended or adjusted under 35 U.S.C. 154(b) by 141 days.

(21) Appl. No.: 17/752,159

(22) Filed: May 24, 2022

(65) Prior Publication Data

US 2022/0381052 A1 Dec. 1, 2022

Related U.S. Application Data

(60) Provisional application No. 63/194,444, filed on May 28, 2021.

(51) Int. Cl.

| | |
|---|---|
| ***E04H 15/30*** | (2006.01) |
| ***E04H 15/04*** | (2006.01) |
| ***E04H 15/34*** | (2006.01) |
| ***E04H 15/64*** | (2006.01) |
| *E04H 6/04* | (2006.01) |

(52) U.S. Cl.

CPC ..... *E04H 15/30* (2013.01); *E04H 15/04* (2013.01); *E04H 15/34* (2013.01); *E04H 15/64* (2013.01); *E04H 6/04* (2013.01)

(58) Field of Classification Search

CPC ..... E04H 15/30; E04H 15/04; E04H 15/34; E04H 15/64; E04H 6/04

USPC ..... 135/90, 95; 52/69

See application file for complete search history.

(56) References Cited

U.S. PATENT DOCUMENTS

| | | | | | |
|---|---|---|---|---|---|
| 645,890 | A * | 3/1900 | Conrad | A01G 13/043 | 135/90 |
| 1,528,629 | A * | 3/1925 | Quinan | E04H 15/003 | 160/183 |
| 1,801,247 | A * | 4/1931 | Hunter | E04H 6/04 | 135/120.2 |
| 2,567,697 | A * | 9/1951 | Craighead, Jr. | E04H 15/04 | 135/90 |
| 3,009,211 | A * | 11/1961 | Hansen | A01K 1/02 | 52/66 |
| 4,296,575 | A * | 10/1981 | Verable | E04H 6/04 | 52/66 |

(Continued)

*Primary Examiner* — Robert Canfield

(74) *Attorney, Agent, or Firm* — Kolitch Romano Dascenzo Gates LLC

(57) ABSTRACT

The tents include a tent frame and an outer tent fabric. The tent frame forms an assembled tent frame defining a base and is configured to support the outer tent fabric above the base. The outer tent fabric is configured to be supported by the assembled tent frame to surround an inner space that interfaces the base of the assembled tent frame. The tent is assembled when the outer tent fabric is operably supported by the assembled tent frame, and the assembled tent is configured to interconvert between a shelter configuration and a canopy configuration. In the shelter configuration, the base of the assembled tent frame extends along the support surface. In the canopy configuration, the base of the assembled tent frame is inclined relative to the support surface. Tents further include a lift coupler configured to interconnect the assembled tent with a tent-elevating support in the canopy configuration.

20 Claims, 9 Drawing Sheets

(56) References Cited

U.S. PATENT DOCUMENTS

| | | | | |
|---|---|---|---|---|
| 4,719,934 | A * | 1/1988 | Mydans | E04H 15/40 135/121 |
| 5,414,966 | A * | 5/1995 | Montoya | E04H 6/04 52/143 |
| 7,467,784 | B2 * | 12/2008 | Turner | B60J 11/00 135/90 |
| 10,907,372 | B1 * | 2/2021 | Mayfield | B60P 3/07 |
| 2016/0168843 | A1 * | 6/2016 | Bell | B60P 3/07 52/64 |

* cited by examiner

DUAL MODE TENT

RELATED APPLICATION

This application claims priority to similarly titled U.S. Provisional Patent Application No. 63/194,444, which was filed on May 28, 2021, and the complete disclosure of which is hereby incorporated by reference.

FIELD

The present disclosure relates to tents, and more specifically to tents with interconverting configurations.

BACKGROUND

Generally speaking, tents include a tent frame that supports the tent on a ground surface and one or more tent fabrics that are supported by the tent frame to enclose an internal volume. Tents often are used as a portable shelter for activates such as backpacking, hunting, camping, and the like. Particularly for recreational use, tents often are designed to be lightweight while providing an enclosure for sleeping and protection from the elements. As such, many traditional tents have limited head space, low entrances, and provide a somewhat constrained living space that is best suited for sitting or lying down within the tent. While larger tents may provide a higher headspace with easier ingress and egress to the enclosure, larger tents typically are heavier and often are not suitable for applications such as backpacking. Thus, a need exists for tents that may be lightweight, configured to provide thorough protection from the elements in one configuration, such as while sleeping, and configured to provide a larger living space with easier ingress and egress thereto in another configuration, such as while socializing.

SUMMARY

Tents are disclosed herein. The tents include a tent frame and an outer tent fabric. When assembled, the tent frame forms an assembled tent frame that defines a base and that is configured to support an outer tent fabric above the base and support the tent on a support surface. When supported by the assembled tent frame, the outer tent fabric is configured to surround an inner space that interfaces the base of the assembled tent frame. The tent forms an assembled tent when the outer tent fabric is operably supported by the assembled tent frame. The assembled tent is configured to selectively interconvert between a shelter configuration and a canopy configuration. In the shelter configuration, the base of the assembled tent frame extends along the support surface, and the inner space surrounded by the outer tent fabric interfaces the support surface. In the canopy configuration, the base of the assembled tent frame is inclined relative to the support surface, and the inner space surrounded by the outer tent fabric is accessible through the base of the assembled tent frame. The tent further includes a lift coupler that is configured to selectively and operably interconnect the assembled tent with a tent-elevating support to selectively support the assembled tent in the canopy configuration.

DETAILED DESCRIPTION

Figure 1:
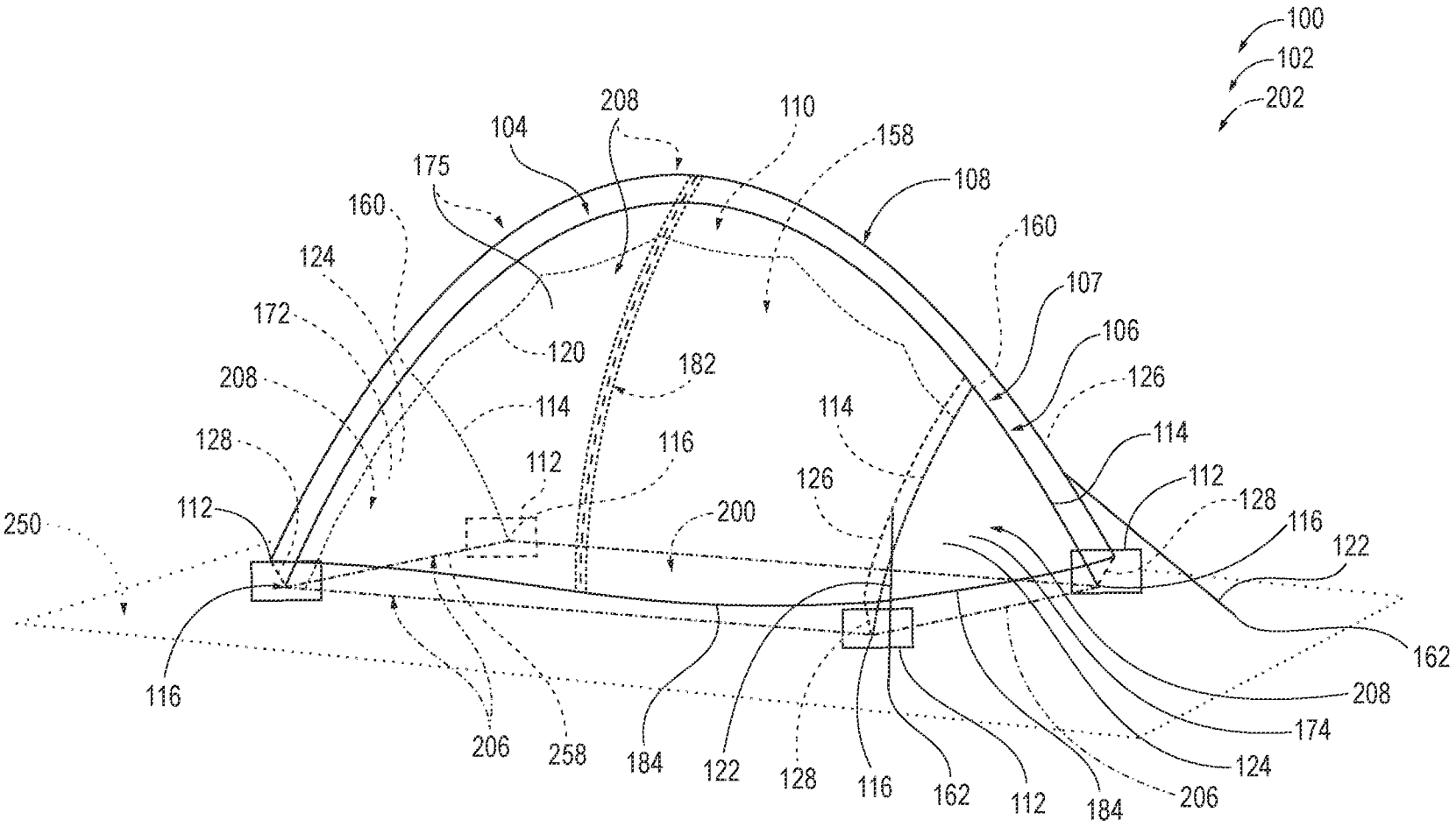
FIG. 1 is a schematic representation showing examples of assembled tents in a shelter configuration according to the present disclosure.

Hereinafter, the examples of tents according to the present disclosure that are disclosed herein will be described in detail with reference to the accompanying drawings, in which identical or similar reference numbers are given to identical or similar elements, and an overlapping description is omitted herein. FIGS. 1-10 provide examples of tents 100 and methods 500 of utilizing tents 100 according to the present disclosure. Elements that serve a similar, or at least substantially similar, purpose are labelled with like numbers in each of FIGS. 1-10, and these elements may not be discussed in detail herein with reference to each of FIGS. 1-10. Similarly, all elements may not be labelled in each of FIGS. 1-10, but reference numbers associated therewith may be utilized herein for consistency. Elements, components, and/or features that are discussed herein with reference to one or more of FIGS. 1-10 may be included in and/or utilized with any of FIGS. 1-10 without departing from the scope of the present disclosure.

Generally, in the drawings, elements that are likely to be included in a given example are illustrated in solid lines, while elements that are optional or alternatives are illustrated in dashed lines. However, elements that are illustrated in solid lines are not essential to all embodiments of the present disclosure, and an element shown in solid lines may be omitted from a particular embodiment without departing from the scope of the present disclosure. In schematic FIGS. 1-4, dash-dot lines are utilized to indicate virtual features that may be defined by tents 100 and/or components thereof, such as dimensions, planes, configurations, etc., and dotted lines are utilized to indicate features and/or structure that may be environment to tents 100.

Figure 2:
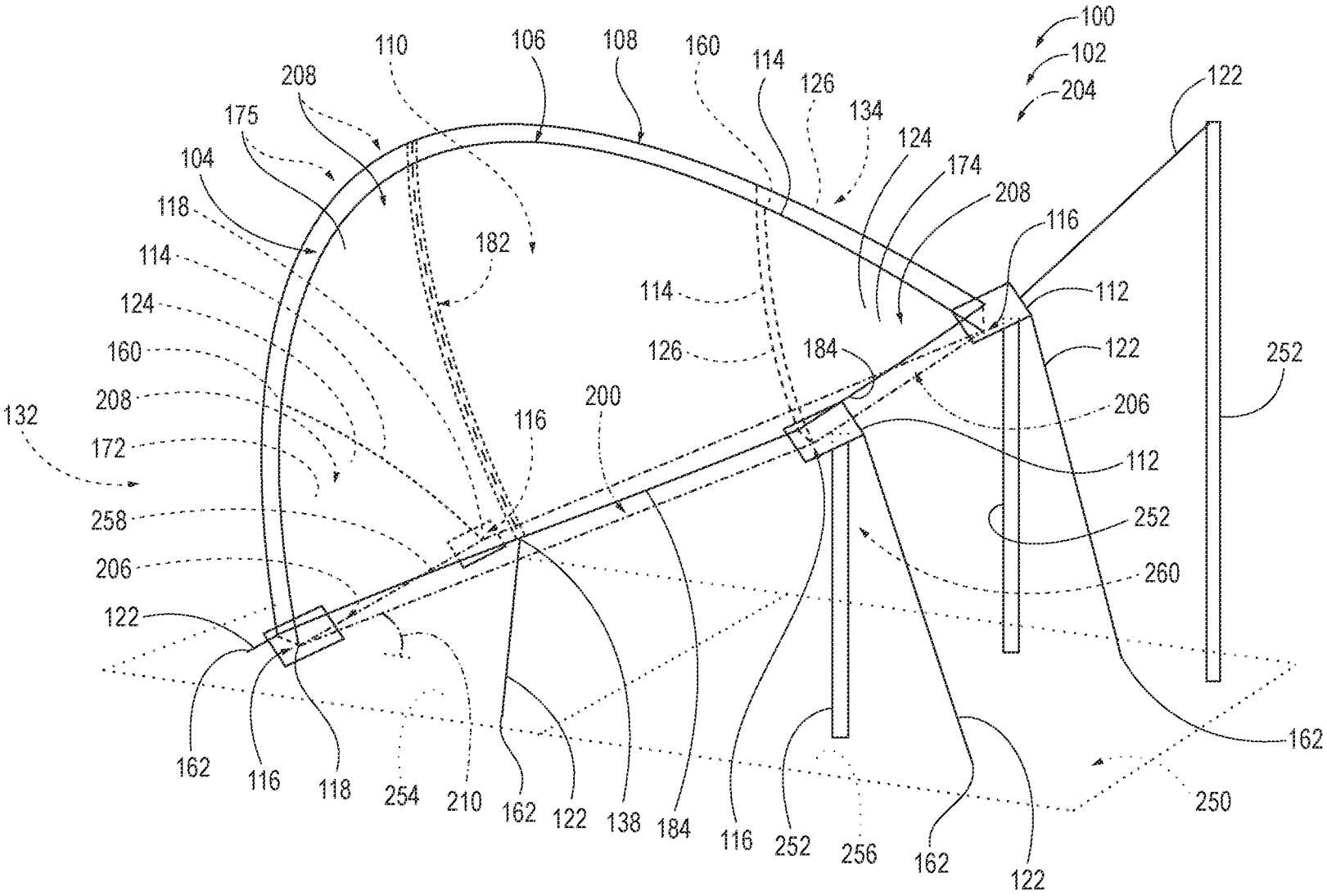
FIG. 2 is a schematic representation showing examples of assembled tents in a canopy configuration according to the present disclosure.

FIG. 1 is a schematic isometric view of tents 100 in a shelter configuration 202 according to the present disclosure, and FIG. 2 is a schematic isometric view of tents 100 in a canopy configuration 204 according to the present disclosure. With reference to FIGS. 1 and 2, tents 100 include a tent frame 104 that is configured to be assembled to form an assembled tent frame 106. Assembled tent frame 106 defines a base 200, and assembled tent frame 106 is configured to support at least an outer tent fabric 108 above base 200. Assembled tent frame 106 also is configured support an assembled tent 102 on a support surface 250. Tents 100 also include outer tent fabric 108 that is configured to be operably coupled to, and surround at least a portion of, the assembled tent frame 106. When outer tent fabric 108 is operably supported by assembled tent frame 106, outer tent fabric 108 is configured to surround an inner space 110 that interfaces base 200 of assembled tent frame 106. Inner space 110 additionally or alternatively may be referred to herein as the inner volume of outer tent fabric 108, and/or the surrounded volume of outer tent fabric 108. As referred to herein, inner space 110 of outer tent fabric 108 "interfacing" base 200 of assembled tent frame 106 means that inner space 110 defines a geometric side, or face, that is at least substantially aligned with, or parallel to, base 200, and that at least a portion thereof is proximate to and/or closely adjacent to base 200 of assembled tent frame 106. For example, the at least one geometric side, or portion thereof, of inner space 110 may be within at least 1 centimeter (cm), at least 2 cm, at least 5 cm, at least 10 cm, at most 2 cm, at most 4 cm, at most 6 cm, at most 10 cm, at most 20 cm, and/or at most 30 cm in vertical separation from base 200. The at least one geometric side, or portion thereof, of inner space 110 also may be parallel to, or at least substantially parallel to, base 200. The at least one geometric side, or portion thereof, of inner space 110 may be defined by bottom edges 184 of outer tent fabric 108.

Tents 100 also may include an inner tent fabric 120 that is configured to selectively and operably couple to assembled tent frame 106 to surround an inner tent space 158. As shown in FIG. 1, when operably coupled to assembled tent frame 106, outer tent fabric 108 may extend over and/or contact at least a portion of the exterior of assembled tent frame 106, while inner tent fabric 120 may be hung from, and/or extend below, an underside of assembled tent frame 106.

Tents 100 are described herein as forming an assembled tent 102 when tent frame 104 is assembled to form assembled tent frame 106 and either or both of inner tent fabric 120 and outer tent fabric 108 are operably coupled to assembled tent frame 106. As referred to herein, outer tent fabric 108 being "operably coupled" to assembled tent frame 110 may include outer tent fabric 108 being coupled to assembled tent frame 106 such that outer tent fabric 108 surrounds inner space 110. Likewise, inner tent fabric 120 being "operably coupled" to assembled tent frame 106 may refer to inner tent fabric 120 being coupled to assembled tent frame 106 such that inner tent fabric 120 surrounds inner tent space 158.

Assembled tents 102 according to the present disclosure include a shelter configuration 202 and a canopy configuration 204, and assembled tents 102 are configured to selectively interconvert between shelter configuration 202 and canopy configuration 204. As shown in FIG. 1, in shelter configuration 202, base 200 of assembled tent frame 106 extends along support surface 250, inner space 110 is surrounded by outer tent fabric 108, and inner space 110 interfaces support surface 250. As shown in FIG. 2, in canopy configuration 204, base 200 of assembled tent frame 106 is inclined relative to support surface 250, outer tent fabric 108 surrounds inner space 110, and inner space 110 is accessible and/or open through base 200 of assembled tent frame 106. For examples in which tents 100 include inner tent fabric 120, inner tent fabric 120 is at least partially, and typically completely, decoupled from assembled tent frame 106 in canopy configuration 204, such that inner space 110 is accessible or open through base 200.

Tents 100 further include at least one lift coupler 112 that is configured to selectively and operably interconnect assembled tent 102 with a tent-elevating support 252 to selectively support assembled tent 102 in canopy configuration 204. Tent-elevating support 252 may include any suitable structure that extends upwardly from support surface 250 and/or that may be adapted, positioned, and/or oriented to extend upwardly from support surface 250 to support assembled tent 102 in canopy configuration via lift coupler 112. As more specific examples, tent-elevating support 252 may include a tree, a branch, one or more tent poles, a trekking pole, a ski pole, and/or a vehicle. More specific examples of lift couplers 112 are illustrated and discussed in more detail herein with reference to FIGS. 3 and 4. As discussed in more detail herein, tent 100 may include a plurality of lift couplers 112 that may be utilized to operatively couple tent 100 to at least one tent-elevating support 242, and optionally a plurality of respective tent-elevating supports 252, in canopy configuration 204. In some examples, tents 100 include a corresponding plurality of tent-elevating supports 252, such as a plurality of tent poles configured to be utilized as tent-elevating supports 252.

In shelter configuration 202, assembled tent 102 may form a partial, complete, or an at least substantially complete enclosure that partitions inner space 110 from the environment surrounding outer tent fabric 108. For example, outer tent fabric 108 may include one or more outer tent fabric doors 182. In shelter configuration 202, a user may selectively access or enter inner space 110 through one or more doors provided in outer tent fabric 108, but inner space 110 may not be accessible through base 200 of assembled tent frame 106 due to an insufficiently sized opening or a floor of the inner tent fabric forming a physical barrier that prevents access to inner space 110. Thus, shelter configuration 202 may be utilized in situations where more comprehensive protection from the environment surrounding outer tent fabric 108 is desired, for example, during periods of inclement weather, in the presence of pests (e.g., bugs), and/or for sleeping. In canopy configuration 204, base 200 of assembled tent frame 106 is inclined relative to support surface 250, such that outer tent fabric 108 may provide overhead protection to a canopy region 260 that includes inner space 110 and the volume between the inclined base 200 and support surface 250. Thus, assembled tent 102 may provide overhead coverage with a higher headspace in canopy configuration 204 than in shelter configuration 202. Also in canopy configuration 204, at least one side of canopy region 260 may be open for ingress or egress, and outer tent fabric 108 may provide a wind block and/or a sun block to canopy region 260 in at least one, two, or even three orthogonal directions. Thus, canopy configuration 204 may be utilized in situations where a higher overhead protection is desired with easy access to a covered, wind-protected, and/or sun-protected area (e.g., when cooking or sitting with protection from the sun or rain), but where complete or comprehensive protection from the elements is not necessarily needed.

One or more outer tent fabric doors 182 of outer tent fabric 108 may be selectively opened, or secured open, in canopy configuration 204. In this way, canopy region 260 or inner space 110 may be accessed or open to the environment through more than one direction via outer tent fabric doors 182. Thus, while the present disclosure refers to outer tent fabric 108 surrounding inner space 110 in canopy configuration 204 and in shelter configuration 202, it should be understood that outer tent fabric doors 182 may be selectively opened and/or secured open in either or both of canopy configuration 204 and in shelter configuration 202. In other words, outer tent fabric 108 may be referred to herein as "surrounding" inner space 110 while outer tent fabric door(s) 182 are open, or secured open, and while outer tent fabric door(s) 182 are closed.

With continued reference to FIGS. 1 and 2, tent frame 104 may include a plurality of tent poles 114 that are interconnected with one another to form assembled tent frame 106. When interconnected to form assembled tent frame 106, the plurality of tent poles 114 collectively include a plurality of ground-contacting ends 116 that define base 200 and that engage support surface 250 in the shelter configuration 202. In other words, base 200 of assembled tent frame 106 may be defined as a closed polygonal shape having a plurality of vertices, at which the ground-contacting ends 116 are respectively positioned, and a plurality of base sides 206, each extending between two adjacent vertices. For many tent constructions, a single ground-contacting end 116 is positioned at each vertex of base 200. However, it also is within the scope of the present disclosure that assembled tent frame 106 may be configured such that two ground-contacting ends 116 are positioned at a single vertex of base 200, such that at least two tent poles 114 of the plurality of tent poles extend upwardly from a common vertex.

Each tent pole 114 may include one ground-contacting end 116, two ground-contacting ends 116, and/or no ground-contacting ends 116. More specifically, assembled tent frame 106 may include one or more tent poles 114 that are arched or bent such that both ends of the tent pole 114 are ground-contacting ends 116. Additionally or alternatively, assembled tent frame 106 may include tent poles 114 having only one ground-contacting end 116, with the other end of the tent pole 114 being positioned over or above the ground-contacting end 116, and that may be interconnected with one or more other tent poles 114, for example, via a tent pole hub 160. Tent poles 114 which include at least one ground-contacting end 116 may be referred to as leg poles. Assembled tent frame 106 also may include one or more tent poles 114 that do not include ground-contacting ends 116, in which case one or both ends of the tent pole 114 may be interconnected with the upper ends of one or more other tent poles 114, such as via tent pole hubs 160. Such tent poles 114 may be referred to as roof poles and/or ridge poles.

Assembled tent frame 106 may include any suitable number of ground-contacting ends 116. For example, the number of ground-contacting ends 116 may be selected based upon the size of the tent and/or the particular construction of the assembled tent frame. As more specific examples, assembled tent frame 106 may include at least three, at least four, at least five, at least six, at most four, at most five, at most six, at most seven, at most eight, and/or at most ten ground-contacting ends. Tents 100 are configured to be assembled to form assembled tent 102 and may be configured to be disassembled and optionally stowed in a disassembled configuration. At least one, and optionally each, tent pole 114 may include a plurality of pole segments that are interconnected in an end-to-end relationship to form a tent pole 114. Such a tent pole 114 may be referred to as a collapsible tent pole or segmented tent pole. Each pole segment may be partially telescoping and may be interconnected by a flexible cord, such as an elastic cord, that urges the pole segments into an end-to-end relationship once assembled. Such a tent pole 114 also may be configured to be collapsed in length by disconnecting the pole segments and folding the pole segments into a side-by side relationship.

Tents 100 may include any suitable type of tent frame 104. For example, tent frame 104 may be configured such that assembled tent frame 106 is free-standing tent frame, meaning the plurality of tent poles 114 interconnect with one another to form a self-supporting structure that extends above support surface 250 without attachment to and/or tension from inner tent fabric 120 and/or outer tent fabric 108. Alternatively, tent frame 104 may be non-freestanding, in which case, the plurality of tent poles 114 require attachment to inner tent fabric 120 and/or outer tent fabric 108 to form a freestanding structure, and tent frame 104 may not form assembled tent frame 106 without being attached to one or more of inner tent fabric 120 and/or outer tent fabric 108.

In the assembled tent 102, outer tent fabric 108 may be operably coupled to at least some of, and optionally all of, the ground-contacting ends 116. In particular, outer tent fabric 108 may include a plurality of tent frame couplers 128, with each tent frame coupler 128 being configured to operably couple outer tent fabric 108 to a separate ground-contacting end 116. As referred to herein, tent frame coupler 128 being configured to operably couple to a ground-contacting end 116 may include tent frame coupler 128 being configured to operably couple to an end region of tent pole 114 that is immediately adjacent ground-contacting end 116 and which may be configured to selectively receive and engage tent frame coupler 128. In assembled tent frame 106, tent poles 114 also may be described as forming a framework 107 that extends above and between ground-contacting ends 116, and ground-contacting ends 116 to which outer tent fabric 108 is operably coupled may tension outer tent fabric 108 over at least a portion of, and optionally all of, framework 107 such that outer tent fabric 108 surrounds inner space 110.

When assembled tent 102 is in canopy configuration 204, fewer than all of the ground-contacting ends 116 are in contact with support surface 250. More specifically, in canopy configuration 204, a first subset of the ground-contacting ends 116 may engage support surface 250, and a second subset of ground-contacting ends 116 may be supported spaced above support surface 250. As shown in the examples of FIG. 2, the first subset of ground-contacting ends 116 may be positioned along opposed sides or regions of base 200 from one another. The first subset of ground-contacting ends 116 and the second subset of ground-contacting ends 116 each may include any suitable number of ground-contacting ends 116. As examples, the first subset of ground-contacting ends 116 may include at least 2, at least 3, at least 4, at most 2, at most 3, and/or at most 4 ground-contacting ends 116. The second subset of ground-contacting ends 116 may include at least 1, at least 2, at least 3, at least 4, at least 6, at most 2, at most 4, at most 6, and/or at most 8 ground-contacting ends.

As shown in FIG. 1, both the first subset and the second subset of ground-contacting ends 116 may be engaged with support surface 250 in shelter configuration 202. In some examples, the second subset of ground-contacting ends 116 are moved upwardly relative to support surface 250 to transition assembled tent 102 from shelter configuration 202 to canopy configuration 204. Likewise, the second subset of ground-contacting ends 116 may be moved downwardly relative to support surface 250 to transition assembled tent 102 from canopy configuration 204 to shelter configuration 202.

In some examples, the first subset of ground-contacting ends 116 defines fulcrum ends 118, such as a pair of fulcrum ends 118, about which assembled tent 102 pivots to interconvert between shelter configuration 202 and canopy configuration 204. In such examples, and in canopy configuration 204, fulcrum ends 118 support a first portion 132 of assembled tent 102 on support surface 250, and lift coupler 112 supports a second portion 134 of the assembled tent frame on support surface 250 via tent-elevating support 252. In this way, fulcrum ends 118 may be defined and/or selected by the position of lift coupler 112 along assembled tent 102. More specifically, fulcrum ends 118 may include a pair of ground-contacting ends 116 that are positioned along base 200 at least substantially opposed to a position of lift coupler 112 along assembled tent 102.

Fulcrum ends 118 may be positioned at adjacent vertices of base 200, such that a single base side 206 extends between fulcrum ends 118. Stated in slightly different terms, base 200 of assembled tent frame 106 may be described as having a pair of fulcrum vertices about which assembled tent frame 106 pivots to interconvert between canopy configuration 204 and shelter configuration 202. In particular, the pair of fulcrum vertices may be positioned adjacent to one another along base 200 such that a single base side 206, which may be referred to as a fulcrum base side 258, extends between the fulcrum vertices. As mentioned, in some examples, assembled tent frame 106 is configured such that two ground-contacting ends 116 are positioned at a single vertex of base 200. With this in mind, each fulcrum vertex may be defined by a single ground-contacting end 116, or two ground-contacting ends 116.

With continued reference to FIGS. 1 and 2, assembled tent 102 may be described as having a plurality of tent sides 208, at least some of which being aligned with and extending upwardly from a corresponding base side 206 of base 200. Lift coupler 112 may be disposed along or adjacent to a tent side 208 that is opposed to fulcrum base side 258. In this way, to convert assembled tent 102 from shelter configuration 202 to canopy configuration 204, lift coupler 112, or the tent side 208 of assembled tent 102 along or adjacent to which lift coupler 112 is attached, may be moved upwardly relative to support surface 250, thereby pivoting or inclining base 200 about fulcrum base side 258, and lift coupler 112 then may be connected with tent-elevating support 252 to secure assembled tent 102 in canopy configuration 204. Similarly, to convert assembled tent 102 from canopy configuration 204 to shelter configuration 202, lift coupler 112 may be detached from tent-elevating support 252 and moved downwardly relative to support surface 250 until each ground-contacting end 116 engages support surface 250.

As a more specific example, tent sides 208 may include a head side 172, a foot side 174 and lateral sides 175 that extend between head side 172 and foot side 174. In some examples, outer tent fabric door 182 is disposed along a lateral side 175. In some examples, lateral sides 175 are longer than head side 172 and foot side 174, for example, when assembled tent 102 is configured for accommodating one, two, three, or four people in shelter configuration 202. In such examples, lift coupler 112 may be disposed along or adjacent to one of head side 172 and foot side 174 with the other of head side 172 and foot side 174 being positioned along fulcrum base side 258. Such a configuration may afford canopy region 260 with a higher headspace when assembled tent 102 is configured in canopy configuration 204. As discussed in more detail herein, assembled tent 102 may be configured such that head side 172 is higher than foot side 174 in shelter configuration 202, and lift coupler 112 preferably may be attached to foot side 174 of assembled tent 102 in such a configuration.

Lift coupler 112 may be attached to any suitable portion of assembled tent 102 and/or may be disposed along any suitable region of assembled tent 102. As an example, lift coupler 112 may be coupled to outer tent fabric 108 and may extend outwardly from an exterior surface of outer tent fabric 108. In particular, outer tent fabric 108 may include a plurality of panels 124 and a plurality of seams 126 that interconnect the plurality of panels 124 with one another. Lift coupler 112 may be attached to outer tent fabric 108 along or adjacent to a base region of a seam 126. In other words, lift coupler 112 may be attached to a base region of a seam 126 or to a base region of a panel 124 adjacent to a seam 126. As referred to herein, the base region of seam 126 or panel 124 is the region of seam 126 or panel 124 that is nearest, or proximate to, bottom edges 184 of outer tent fabric 108. In other words, the base region of seam 126 or panel 124 is the region of seam 126 or panel 124 that is nearest, or proximate to, base 200 of assembled tent frame 106 when outer tent fabric 108 is operably coupled to assembled tent frame 106. Generally speaking, positioning lift coupler 112 along the base region of panel 124 or seam 126 may enable base 200 to be tilted farther above support surface 250 in canopy configuration 204, thereby enhancing ingress and egress to inner space 110 in canopy configuration 204. Additionally, positioning lift coupler 112 along or adjacent to a seam 126 may enhance stability of assembled tent 102 in canopy configuration 204.

In assembled tent 102, at least some of seams 126 of outer tent fabric 108 may extend upwardly from ground-contacting ends 116 of assembled tent frame 106 and/or may extend at least partially aligned with or along the tent poles 114 that include ground-contacting ends 116. For example, outer tent fabric 108 may include a plurality of tent frame couplers 128, each being configured to selectively and operably couple outer tent fabric 108 to a given ground-contacting end 116 of assembled tent frame 106. Tent frame coupler 128 may be coupled to and/or extend from a base, or base region, of seams 126 of outer tent fabric 108, such that tent frame couplers 128 may position one or more seams 126 of outer tent fabric 108 to extend along or adjacent to one or more respective tent poles 114 of assembled tent frame 106. As such, lift coupler 112 may be attached to outer tent fabric 108 to be positioned adjacent to a given ground-contacting end 116 and/or tent pole 114 that extends therefrom in assembled tent 102. Lift coupler 112 also may be attached to outer tent fabric 108 adjacent to a given tent frame coupler 128. That said, lift coupler 112 may be attached to outer tent fabric 108 separately from tent frame coupler 128, such that operation of lift coupler 112 does not interfere with operation of tent frame coupler 128, and vice versa.

Tents 100 may include a plurality of lift couplers 112, which may be utilized simultaneously with and/or separately from one another in various canopy configurations 204. Each lift coupler 112 may be configured to selectively and operably interconnect assembled tent 102 with a respective tent-elevating support 252 to support assembled tent 102 in canopy configuration 204. As an example, tents 100 may include a pair of lift couplers 112 that are utilized together (i.e., in tandem) to support assembled tent 102 in canopy configuration 204. In such an example, the pair of lift couplers 112 may engage with the same tent-elevating support 252 to support assembled tent 102 in canopy configuration 204. Alternatively, and as schematically shown in FIG. 2, each lift coupler 112 of the pair may engage with a separate tent-elevating support 252 to support assembled tent 102 in canopy configuration 204. In other words, the pair of lift couplers 112 may be configured to operatively interconnect assembled tent 102 with a respective pair of tent-elevating supports 252.

The pair of lift couplers 112 may be disposed along or adjacent to the same tent side 208 of assembled tent 102 as one another. In this way, moving the lift couplers 112 upwardly and downwardly relative to support surface 250 may pivot assembled tent 102 about a fulcrum base side 258 that is opposed to the tent side 208 along which the pair of lift couplers 112 are attached. As a more specific example, a given panel 124 of outer tent fabric 108 may be bonded along two edges to two adjacent panels 124 by a pair of seams 126. In assembled tent 102, each seam 126 of the pair of seams 126 may extend upwardly from a respective ground-contacting end 116 of assembled tent frame 106, and the pair of lift couplers 112 may be attached to outer tent fabric 108 along or adjacent to the base regions of the pair of seams 126.

Tents 100 additionally or alternatively may include a plurality of lift couplers 112 to allow a user to choose which side of assembled tent 102 is raised in canopy configuration 204 and/or which ground-contacting ends 116 are utilized as fulcrum ends 118. In particular, each lift coupler 112 may be disposed along or adjacent to a tent side 208 that is at least substantially opposed to a pair of ground-contacting ends 116 that may be utilized as fulcrum ends 118. Thus, in such a configuration, assembled tent 102 may include a plurality of pairs of fulcrum ends 118, and assembled tent 102 may be configured to selectively pivot independently about each pair of fulcrum ends 118 to interconvert between shelter configuration 202 and canopy configuration 204.

As indicated above, outer tent fabric 108 is operatively coupled to assembled tent frame 106 and may extend over or surround assembled tent frame 106 in canopy configuration 204. In assembled tent 102, assembled tent frame 106 may support outer tent fabric 108 to form a predefined shape, and the predefined shape formed by outer tent fabric 108 may be at least substantially the same in canopy configuration 204 as in shelter configuration 202. Similarly, base 200 of assembled tent frame 106 may define at least substantially the same shape when assembled tent 102 is in canopy configuration 204 as when assembled tent is in shelter configuration 202.

In canopy configuration 204, assembled tent 102 may be supported such that base 200 of assembled tent frame 106 forms any suitable incline angle 210 with support surface 250. As examples, incline angle 210 formed between base 200 and support surface 250 in canopy configuration 204 may be at least at least 15 degrees (°), at least 20°, at least 23°, at least 25°, at least 27°, at least 30°, at least 33°, at least 35°, at least 40°, at least 45°, at least 50°, at least 55°, at most 20°, at most 23°, at most 25°, at most 27°, at most 30°, at most 35°, at most 40°, at most 45°, at most 50°, at most 55°, at most 60°, at most 65°, and/or at most 70°. The incline angle 210 that base 200 forms with support surface 250 may be selected based upon the selected height of tent-elevating support 252 and/or the manner in which lift coupler 112 is attached to tent-elevating support 252. Generally speaking, assembled tent 102 will provide a canopy region 260 with a larger headspace and a smaller covered floor space for increasingly large incline angles 210 formed between base 200 and support surface 250.

Lift coupler 112 may be configured to engage with tent-elevating support 252 in any suitable manner to support assembled tent 102 in canopy configuration 204. As examples, lift coupler 112 may be supported upon, supported atop, received on, hung from, hooked onto, looped around, and/or looped over tent-elevating support 252 to support assembled tent 102 in canopy configuration 204. For examples in which lift coupler 112 is supported upon or on the top of, tent-elevating support 252 (e.g., when tent-elevating support 252 is a trekking pole, a tree branch, and/or a tent pole), the height of tent-elevating support 252 may define the angle formed between base 200 and support surface 250, and/or the height of an entranceway to canopy region 260. In such examples, tent-elevating support 252 may be selected to have a height of at least 100 cm, at least 120 cm, at least 130 at least 140 cm, at least, at least 150 cm, at least 175 cm, at most 130 cm, at most 140 cm, at most 150 cm, at most 160 cm, at most 170 cm, at most 180 cm, and/or at most 190 cm. For examples in which tent-elevating support 252 is taller than the desired height of the entranceway to canopy region 260, lift coupler 112 may be hung from tent-elevating support 252 and/or attached to tent-elevating support 252 at the desired height.

Tent-elevating support(s) 252 may or may not be included in tents 100. For examples in which tent-elevating support(s) 252 are included in tents 100, tents 100 may include at least one collapsible tent pole, and optionally at least a pair of collapsible tent poles that are configured to be utilized as tent-elevating supports 252. That said, tents 100 additionally or alternatively may be configured to utilize tent-elevating supports 252 that are not included in tents 100.

Assembled tent 102 may be supported on the same or different support surfaces 250 in shelter configuration 202 and in canopy configuration 204. For example, assembled tent 102 may be supported on a ground surface in both shelter configuration 202 and in canopy configuration 204. Additionally or alternatively, assembled tent 102 may be supported on two separate support surfaces 250 in canopy configuration 204 and on a single support surface 250 in shelter configuration 202. For example, in canopy configuration 204, first portion 132 of assembled tent 102 may be supported on a first support surface 254, such as by fulcrum ends 118, and second portion 134 of assembled tent 102 may be operably supported on a second support surface 256 via lift coupler(s) 112 and tent-elevating support(s) 252, in which first support surface 254 may be elevated above second support surface 256 but positioned lower than lift couplers 112. In some examples, utilizing a first support surface 254 that is elevated above second support surface 256 to support assembled tent 102 in canopy configuration 204 allows for assembled tent 102 to provide a canopy region 260 with a larger head space while being inclined to a lesser extent. As a more specific example, first support surface 254 may include a table, a bench or chair, or a tailgate, trunk, roof, or hood of a truck or other vehicle, and the second support surface 256 surface may include the ground surface.

In view of the above, transitioning assembled tent 102 between shelter configuration 202 and canopy configuration 204 may not only include pivoting or tilting assembled tent 102, but additionally or alternatively may include lifting, reorienting, canting, and/or rotating assembled tent 102 depending on the desired canopy and shelter configurations.

Tents 100 further may include a plurality of guy lines 122 that may be utilized to tension assembled tent 102 against support surface 250 and/or against tent-elevating support 252. Tents 100 also may include a plurality of ground anchors 162 that may be utilized to secure guy lines 122 to support surface 250. More specifically, in shelter configuration 202, guy lines 122 may be utilized to tension assembled tent 102 directly against support surface 250. Guy lines 122 also may be utilized to support portions of outer tent fabric 108 spaced apart from ground-contacting ends 116 such that outer tent fabric 108 forms an awning, vestibule, and/or porch in shelter configuration 202. In such examples, the one or more sides of assembled tent 102 along which outer tent fabric 108 is tensioned outwardly by guy lines 122 may not be aligned with or extend directly upwardly from the base sides 206 of base 200.

As referred to herein, a guy line 122 may include a cord, a rope, a loop, and/or a strap that is configured with any suitable length. In some examples, guy lines 122 are configured with an adjustable length. Guy lines 122 may be directly or fixedly attached to outer tent fabric 108. Additionally or alternatively, inner tent fabric 120 or outer tent fabric 108 may be configured to releasably couple to guy lines 122, as discussed in more detail herein. For example, guy lines 122 that are directly or fixedly attached to outer tent fabric 108 or inner tent fabric 120 may be shorter than guy lines that releasably couple to outer tent fabric 120 or inner tent fabric 120. Guy lines 122 that are directly or fixedly attached to outer tent fabric 108 or inner tent fabric 120 also may be positioned along the base region of outer tent fabric 108 or inner tent fabric 120. Such guy lines 122 also may be comprised in or attached to tent frame couplers 128.

As shown in FIG. 2, in canopy configuration 204, guy line 122 additionally or alternatively may be utilized to secure lift coupler 112 to tent-elevating support 252, and/or tension lift coupler 112 downwardly against tent-elevating support 252 such as by securing the distal end of guy line 122 to support surface 250. Utilizing guy line 122 to tension lift coupler 112 downwardly against tent-elevating support 252 may stabilize assembled tent 102 in canopy configuration 204. Utilizing guy line 122 to tension lift coupler 112 downwardly against tent-elevating support 252 also may allow tent-elevating supports 252 to be used that are not securely fixed to support surface 250 and/or freestanding on their own. In particular, the downward force applied to tent-elevating support 252 by a downwardly-tensioned guy line 122 via lift coupler 112 may support tent-elevating support 252 in an upright manner in canopy configuration 204. With this in mind, and as discussed in more detail with reference to FIGS. 3 and 4, lift coupler 112 may be configured to selectively couple assembled tent 102 to one or more guy lines 122.

As further shown in FIG. 2, one or more guy lines 122 may be coupled to outer tent fabric 108 along a region of outer tent fabric 108 that is opposed to lift coupler 112, such as to balance the tension applied to outer tent fabric 108 by the guy line 122 that is coupled to lift coupler 112. For example, such guy lines 122 may be coupled to a panel 124 of outer tent fabric 108 that is opposed to lift coupler 112, and/or that extends proximate to fulcrum base side 258 in assembled tent 102. Such guy lines 122 additionally or alternatively may be comprised in tent frame couplers 128 that couple outer tent fabric 108 to fulcrum ends 118. Outer tent fabric 108 further may include guy line couplers 138 attached to lateral sides 175 of outer tent fabric 108, such as at the base of outer tent fabric door 182, that releasably couple lateral sides 175 of outer tent fabric 108 to guy lines 122 that may be anchored outwardly from base 200.

As mentioned, tents 100 may include inner tent fabric 120, in which case tents 100 may selectively be assembled as a double skin tent or a double wall tent. With this in mind, outer tent fabric 108 additionally or alternatively may be referred to as a fly, a rainfly, and/or a flysheet. Unlike outer tent fabric 108, inner tent fabric 120 may include an inner tent fabric floor that extends along support surface 250 in shelter configuration 202 and a plurality of inner tent walls that extend upwardly from the inner tent fabric floor. The inner tent walls and the inner tent floor may selectively enclose inner tent space 158, and inner tent fabric 120 may include one or more doors configured to provide selective access to inner tent space 158. For examples in which tents 100 include both inner tent fabric 120 and outer tent fabric 108, tents 100 may be assembled in shelter configuration 202 with only inner tent fabric 120 operably coupled to assembled tent frame 106, with only outer tent fabric 108 operably coupled to assembled tent frame 106, or with both inner tent fabric 120 and outer tent fabric 108 operably coupled to assembled tent frame 106. However, in canopy configuration 204, outer tent fabric 108 is operably coupled to assembled tent frame 106, and inner tent fabric 120 is at least partially, and optionally completely, decoupled from assembled tent frame 106. With this in mind, inner tent fabric 120 and outer tent fabric 108 may be configured to selectively couple to and selectively decouple from assembled tent frame 106 independently of one another.

While FIGS. 1 and 2 illustrate examples of tents 100 assembled to form assembled tent 102, tents 100 according to the present disclosure may be configured to be selectively assembled to form assembled tent 102 and selectively disassembled to form a disassembled tent, or into a disassembled state. Tents 100 also may be configured to be selectively reassembled from the disassembled state to form assembled tent 102. When tents 100 are disassembled, or are in the disassembled state, outer tent fabric 108 and inner tent fabric 120 may be detached from tent frame 104, and tent frame 104 may be collapsed into a condensed state. More specifically, tent poles 114 that may form tent frame 104 may be at least partially disconnected from one another and folded into a side-by-side relationship. Similarly, when one or more tent poles 114 are formed from interconnected pole segments, the segments may be partially disconnected and folded into a side-by-side relationship. In this way, the components that form tent frame 104 may be generally aligned with one another and stowed and/or transported in the condensed state. That said, at least two tent poles 114 and/or the segments of the one or more tent poles 114 may remain partially interconnected by an elastic cord in the condensed state. Tents 100 further may include a stowage bag that is configured to receive tent frame 104 in the condensed state along with outer tent fabric 108 and optionally inner tent fabric 120.

Figure 3:
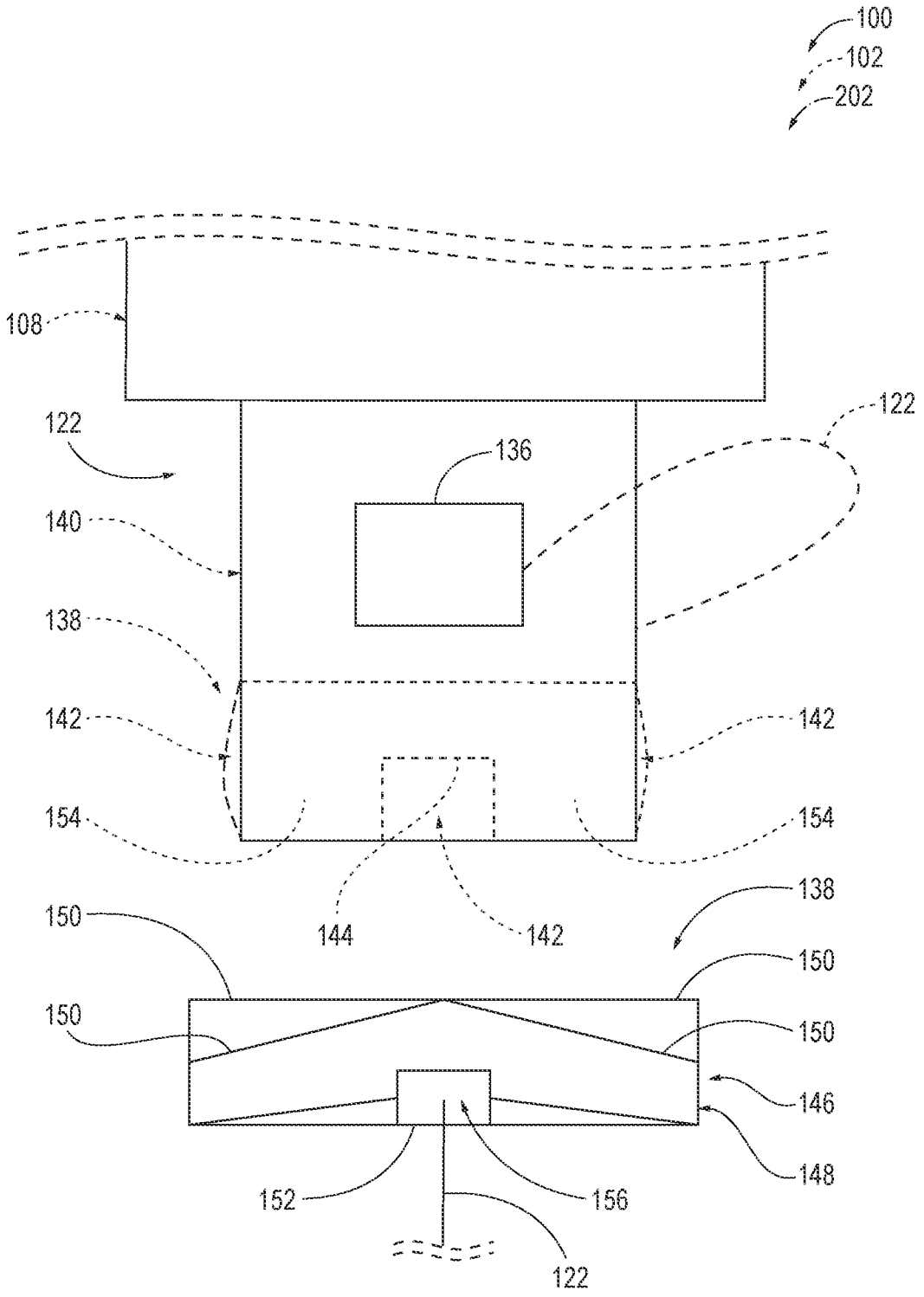
FIG. 3 schematically represents examples of lift couplers that may be included in and/or utilized with tents according to the present disclosure.

FIG. 3 schematically represents examples of lift couplers 112 that may be included in and/or utilized with tents 100 according to the present disclosure. In particular, FIG. 3 schematically represents examples of lift couplers 112 with which tent 100 may be assembled as assembled tent 102 in shelter configuration 202. As shown, lift couplers 112 include an elevating support receiver 136 configured to selectively receive and engage tent-elevating support 252. In particular, elevating support receiver 136 is configured to receive tent-elevating support 252 when assembled tent 102 is in canopy configuration 204, and elevating support receiver 136 is configured to selectively release tent-elevating support 252 to transition assembled tent 102 from canopy configuration 204 to shelter configuration 202. Elevating support receiver 136 may include any suitable structure, mechanism, and/or combinations thereof configured to selectively receive and engage tent-elevating support 252 and to selectively release tent-elevating support 252. As examples, elevating support receiver 136 may include a grommet, a looped guy line 122, a strap having a loop for receiving tent-elevating support 252, a strap having an adjustable loop for receiving tent-elevating support 252, a hook, a slot, a clip, a synch, a latch, and/or combinations thereof.

In some examples, elevating support receiver 136 is configured to selectively engage with a specific tent-elevating support 252 and/or a specific type of tent-elevating support 252. For example, as mentioned, tents 100 may include one or more collapsible tent poles that are configured to be utilized as tent-elevating supports 252. In such an example, the end regions of the collapsible tent poles may include a cylindrical, or otherwise geometrically shaped, recess, and elevating support receiver 136 may be configured selectively receive and engage the recess of the collapsible tent pole. In such an example, elevating support receiver 136 may include a grommet that is dimensioned to selectively receive the cylindrical recess of the collapsible tent pole. Additionally or alternatively, tent-elevating support 252 may include an inverted trekking pole, and elevating support receiver 136 may be configured to selectively receive a pole tip of the inverted trekking pole.

Lift coupler 112 is, or is configured to be, connected to assembled tent 102. For example, lift coupler 112 may be fixedly connected to outer tent fabric 108 and/or lift coupler 112 may be adjustably connected outer tent fabric 108, such as via an adjustable strap.

As mentioned, lift coupler 112 may be coupled to one or more guy lines 122. Additionally or alternatively, lift coupler 112 may be configured to selectively couple to and engage guy line 122 and selectively release guy line 122. In such examples, lift coupler 112 may include a guy line coupler 138 that is configured to selectively receive and engage guy line 122. As shown in FIG. 3, guy line coupler 138 may include a sling 140 that is coupled to outer tent fabric 108. Sling 140 enfolds an interior channel 142 and includes a slot 144 that extends through a side of sling 140 into a central region of interior channel 142. In other words, sling 140 may be looped or folded over such that its interior surface forms interior channel 142, and slot 144 may be cut through the exterior surface of sling 140 into interior channel 142. The lateral sides of interior channel 142 may be open such that interior channel 142 may be described as forming a tubular, open-ended volume.

When included, guy line coupler 138 further includes a guy line anchor 146 that may be configured to be selectively received in and removed from interior channel 142 via slot 144. Guy line coupler 138 interconnects outer tent fabric 108 with guy line 122 when guy line anchor 146 is operably received in interior channel 142 of sling 140. Guy line coupler 138 includes a body 148 that forms a pair of projections 150, and a guy-line-receiving region 152 positioned at least partially between the pair of projections and configured to receive guy line 122. Projections 150 may extend along two respective directions that are at least partially, at least substantially, or fully opposed to one another. Interior channel 142 of sling 140 may be described as having a pair of channel portions 154 that extend outwardly from either side of slot 144. When guy line anchor 146 is operably received (i.e., received to interconnect sling 140 to guy line 122), projections 150 of guy line anchor 146 are respectively positioned within channel portions 154 and engage with the interior surface of sling 140.

As shown in FIG. 3, projections 150 may extend at an angle relative to one another, such as to form an inverted V-shape, a delta-type shape, or a boomerang-type shape. In such examples, projections 150 may extend at any suitable angle relative to one another, with 180° designating a configuration in which projections 150 extend in opposed and parallel directions or do not extend at an angle relative to one another. As examples, the angle formed between projections 150 may be at most 180°, at most 170°, at most 160°, at most 150°, at most 135°, at most 120°, at most 100°, at least 170°, at least 160°, at least 150°, at least 135°, at least 120°, at least 100°, and/or at least 90°.

When projections 150 extend at an angle relative to one another, guy-line-receiving region 152 may be configured to orient guy line 122 to extend from an interior 156 of the angle formed between projections 150, or such that an acute angle is formed between the direction along which either projection 150 extends and the direction along which guy line 122 is oriented to extend. When guy line anchor 146 is received in interior channel 142 of sling 140, guy line anchor 146 may be configured to position and/or orient guy line 122 to extend outwardly from interior channel 142 through slot 144.

To position guy line anchor 146 within interior channel 142 of sling 140, a first projection 150 may be fed into a first channel portion 154 of the pair of channel portions 154 via slot 144. Sling 140 then may be compressed and/or the first projection 150 may be pushed outwardly through the open end of the first channel portion 154 such that the other projection 150 may be moved through slot 144 into the other channel portion 154. With this in mind, sling 140 may be formed of a flexible material, a resilient material, fabric, fabric webbing, leather, artificial leather, a plastic, polyurethane, a strap, and/or folded versions thereof. Also with this in mind, guy line anchor 146 may be formed of a material that is less flexible than sling 140, such as metal, aluminum, plastic, rubber, a composite, and/or combinations thereof. Additionally or alternatively, projections 150 optionally may be flexible, or resiliently pivotal relative to one another, at least to the extent that projections 150 may be flexed towards one another during insertion into interior channel 142, and then return to a resting or unstrained configuration once positioned within interior channel 142.

Figure 4:
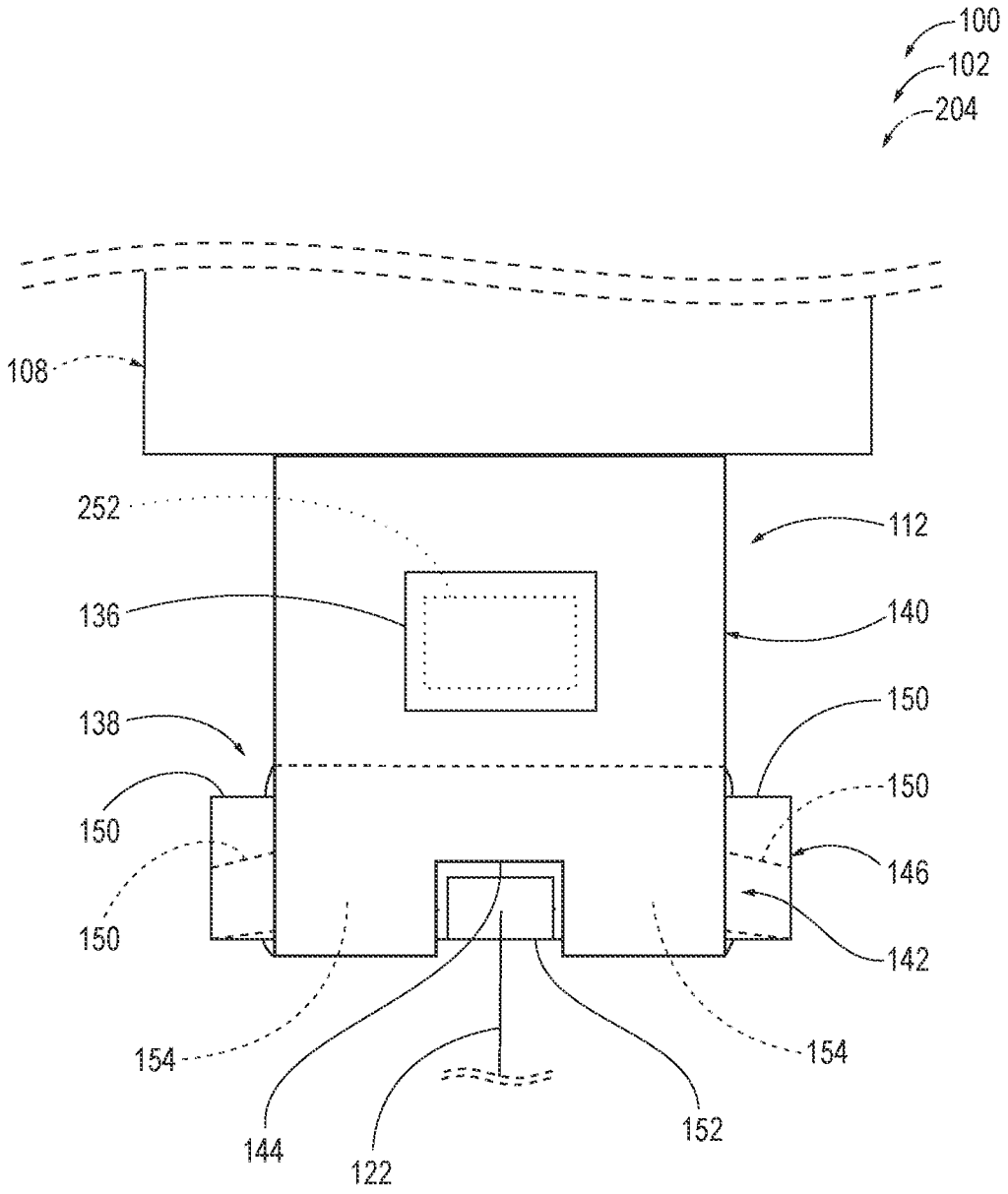
FIG. 4 schematically represents examples of the lift couplers of FIG. 3 operably connected to a guy line.

FIG. 4 schematically represents more specific examples of lift couplers 112 of FIG. 3 that include sling 140 and guy line anchor 146. More specifically, in the examples of FIG. 4, assembled tent 102 is in canopy configuration 204, elevating support receiver 136 is engaged with tent-elevating support 252, and guy line anchor 146 is operably positioned within interior channel 142 of sling 140. As shown, projections 150 of guy line anchor 146 are respectively positioned within channel portions 154 of sling 140, and guy line anchor 146 positions guy line 122 to extend outwardly from interior channel 142 through slot 144. Projections 150 of guy line anchor 146 protrude, or extend outwardly from, the open lateral sides of interior channel 142. In other words, the outermost lateral extent of projections 150 may be greater than that of interior channel 142 and/or sling 140. Particularly for configurations in which projections 150 extend at an angle relative to one another, dimensioning projections 150 such that they protrude from the open lateral sides of interior channel 142 helps to prevent guy line anchor 146 from being undesirably removed from interior channel 142, such as by lateral forces applied to guy line anchor 146 by guy line 122.

As further shown in FIG. 4, elevating support receiver 136 may be coupled to, and/or disposed along, sling 140. Elevating support receiver 136 also may be positioned to the inside of interior channel 142. In other words, elevating support receiver 136 may be positioned closer to outer tent fabric 108 than interior channel 142. In this way, when guy line anchor 146 is operably received in interior channel 142 of sling 140, guy line 122 may apply downward tension to sling 140, which in turn may apply a downward force to tent-elevating support 252, such as for reasons discussed herein. Guy line 122 also may apply outward tension to outer tent fabric 108 via sling 140, such as to enhance the stability of assembled tent 102 against lateral forces (e.g., wind) in canopy configuration 204.

While guy line coupler 138 is illustrated and discussed herein with reference to FIGS. 3 and 4 as being included in lift coupler 112, it is within the scope of the present disclosure that guy line coupler 138 and/or one or more components thereof, may be utilized for other purposes than that discussed herein with reference to lift coupler 112 and/or within different components. For example, tents 100 may include and/or utilize one or more guy line couplers 138, and/or one or components thereof, such as guy line anchor 146, to operably interconnect outer tent fabric 108 directly to support surface 250 in shelter configuration 202 an/or in canopy configuration 204.

Turning to FIGS. 5-9, additional examples of tents 100 are illustrated. Where appropriate, the reference numerals from the schematic illustrations of FIGS. 1-4 are used to designate corresponding parts of the examples of FIGS. 5-9. However, the examples of FIGS. 5-9 are non-exclusive and do not limit tents 100 to the illustrated embodiments of FIGS. 5-9. That is, tents 100 are not limited to the specific embodiments of FIGS. 5-9, and tents 100 may incorporate any number of the various aspects, configurations, characteristics, properties, variants, options etc. of tents 100 that are illustrated in and discussed with reference to the schematic representations of FIGS. 1-4 and/or the embodiments of FIGS. 5-9, as well as variations thereof, without requiring the inclusion of all such aspects, configurations, characteristics, properties, etc. Furthermore, any additional aspects, configurations, characteristics, properties, variants, options, etc. disclosed in connection with the tents 100 of any of FIGS. 5-9 may be used and/or otherwise included with other tents 100 according to the present disclosure, including tents 100 according to FIGS. 1-4 or others of FIGS. 5-9. For the purpose of brevity, each previously discussed component, part, portion, aspect, region, etc. or variants thereof may not be discussed, illustrated, and/or labeled again with respect to the examples of FIGS. 5-9; however, it is within the scope of the present disclosure that the previously discussed features, variants, etc. may be utilized with the examples of FIGS. 5-9.

FIGS. 5-9 illustrate examples of tents 100 assembled to form assembled tents 102. That said, each of the examples of tents 100 illustrated in FIGS. 5-9 also may be configured to be disassembled into a disassembled state, and selectively reassembled therefrom, as discussed herein. In the disassembled state, each of the examples of tents 100 illustrated in FIGS. 5-9 may include each of the same components or parts that are shown in assembled tent 102 in FIGS. 5-9, and may include a kit for forming the examples of assembled tents 102 illustrated in each of FIGS. 5-9.

Figure 5:
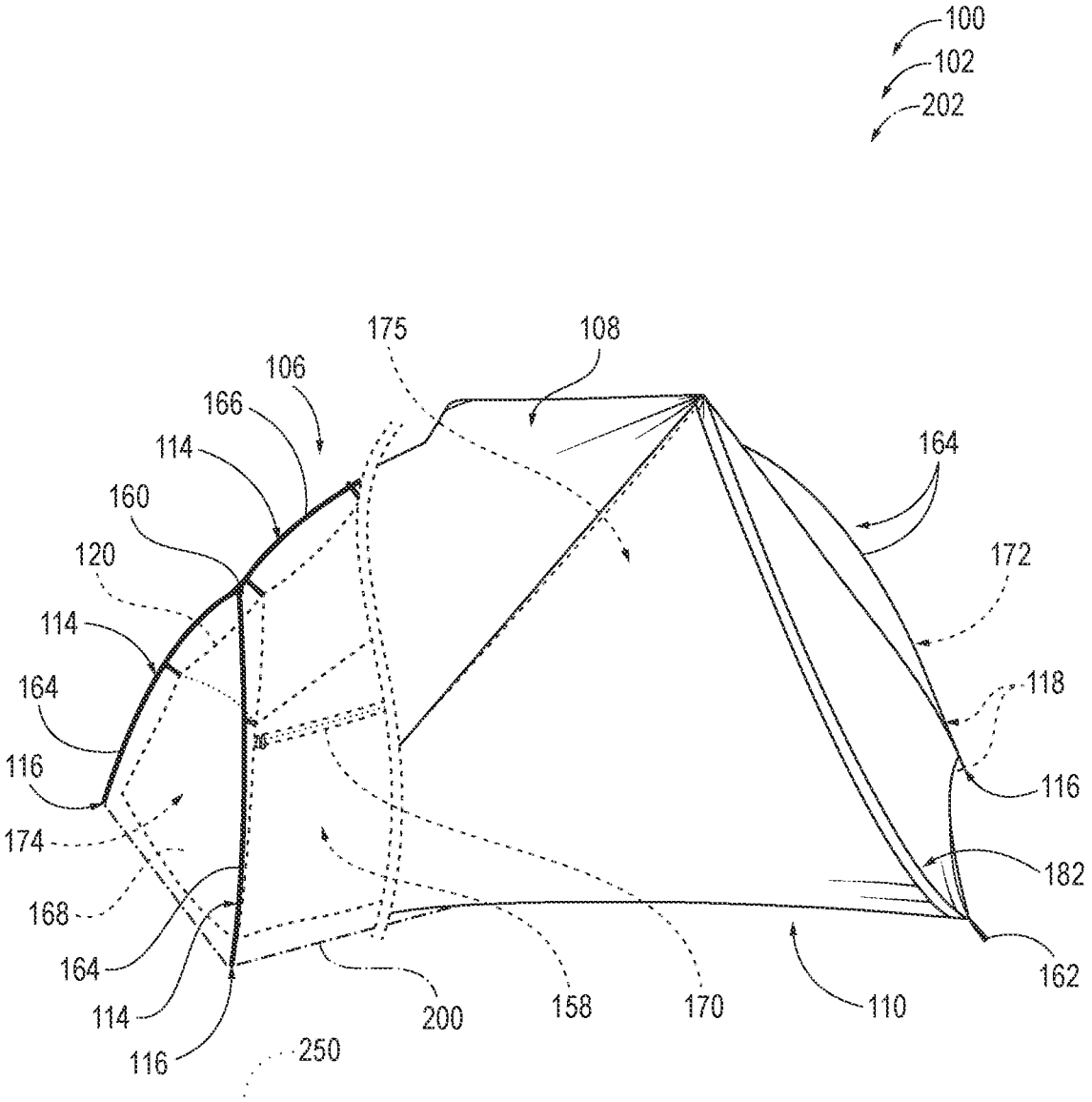
FIG. 5 is a less schematic isometric view illustrating examples of assembled tents in the shelter configuration according to the present disclosure.
Figure 6:
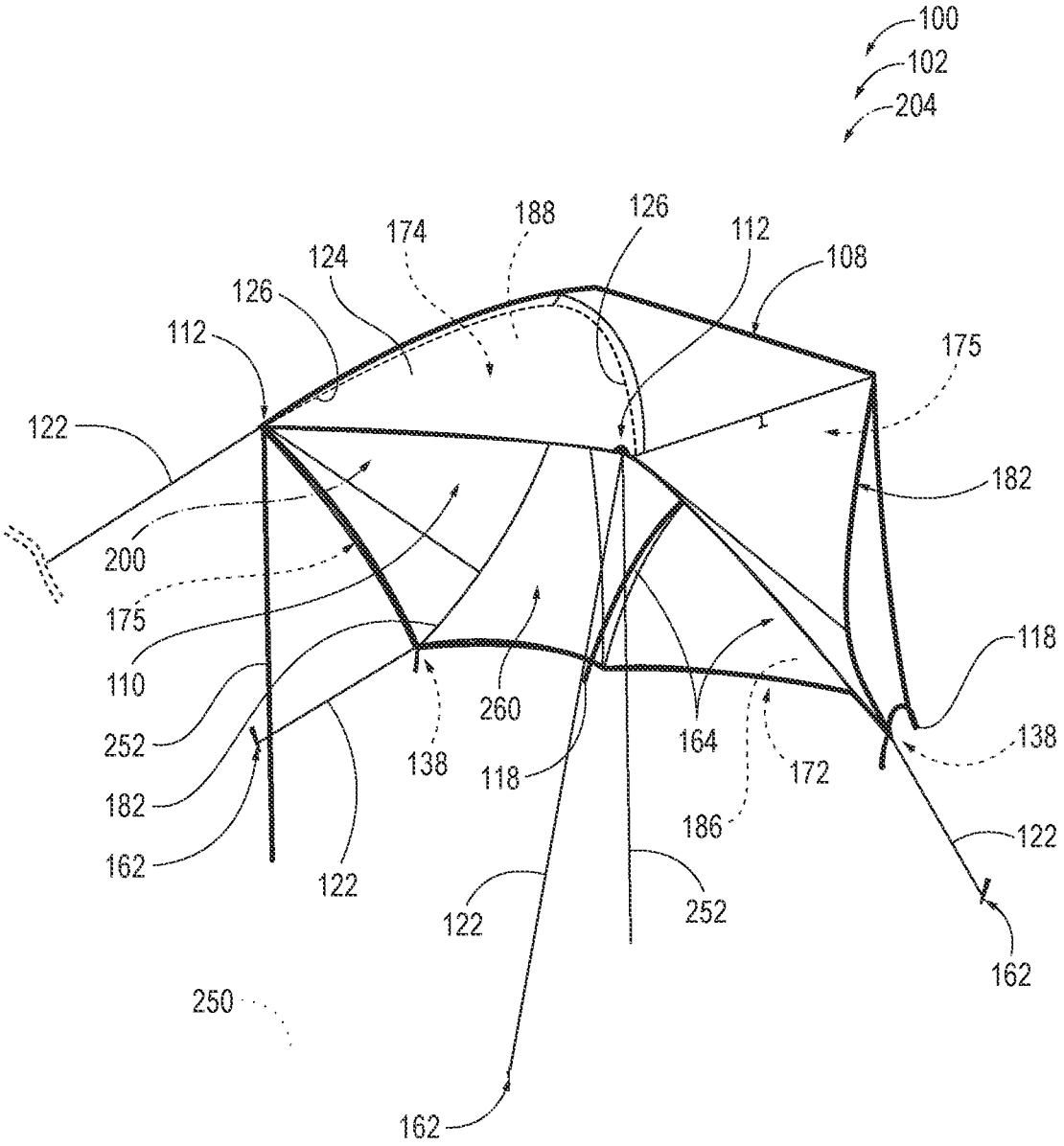
FIG. 6 is a less schematic isometric view illustrating examples of assembled tents in the canopy configuration according to the present disclosure.

FIG. 5 is a partial cutaway perspective view showing less-schematic examples of tents 100 in shelter configuration 202. More specifically, on the right side of the schematic cut line, tent 100 includes outer tent fabric 108 which is shown in solid lines, and on the left side of the schematic cut line, tent optionally includes inner tent fabric 120, which is illustrated in dashed lines. FIG. 6 is an isometric view illustrating an example of tent 100 in canopy configuration 204. Generally with reference to FIGS. 5 and 6, and with initial focus on the shelter configuration 202 shown in FIG. 5, assembled tent frame 106 supports assembled tent 102 on support surface 250, base 200 of assembled tent frame 106 is defined between ground-contacting ends 116 of assembled tent frame 106, and base 200 extends along support surface 250. Assembled tent frame 106 includes a plurality of interconnected tent poles 114 and a roof pole 166. The plurality of interconnected tent poles include two pairs of leg poles 164 that define ground-contacting ends 116. Roof pole 166 extends between and interconnects the two pairs of leg poles 164 via two tent pole hubs 160. In this example, assembled tent frame 106 is a free-standing tent frame in that assembled tent frame 106 forms a free-standing structure without being attached to outer tent fabric 108 and/or inner tent fabric 120.

Outer tent fabric 108 is operably coupled to assembled tent frame 106 and extends over the exterior of assembled tent frame 106 to surround inner space 110. In these examples, a portion of outer tent fabric 108 is anchored to support surface 250 laterally outside of base 200 with a ground anchor 162 to form a vestibule for assembled tent 102. Thus, in these examples, the projected area of inner space 110 onto support surface 250 is larger than the area of base 200. Inner tent fabric 120 is hung from the underside of assembled tent frame 106 and is positioned within inner space 110 when tent 100 is assembled with both inner tent fabric 120 and outer tent fabric 108. Inner tent fabric 120 surrounds, and may selectively enclose, inner tent space 158. Inner tent fabric 120 includes an inner tent fabric floor 168 that extends along support surface 250 and further includes at least one door 170 configured to provide selective access to inner tent space 158.

In these examples, assembled tent 102 may be described as having a head side 172, a foot side 174 that is opposed to head side 172, and two or more lateral sides 175 that extend therebetween. Head side 172 may be the side of assembled tent 102 nearest to which a user typically will place their head when sleeping in assembled tent 102 in shelter configuration 202, and foot side 174 may be the side of assembled tent 102 nearest to which a user typically places their feet when sleeping in assembled tent 102 in shelter configuration 202. Outer tent fabric 108 includes outer tent fabric doors 182, and outer tent fabric doors 182 may be disposed along lateral sides 175 of assembled tent 102.

In some examples, assembled tent frame 106 is constructed such that the pair of leg poles 164 that define head side 172 are longer than the pair of leg poles 164 that define foot side 174. In such examples, it may be desirable for lift coupler(s) 112 to be operatively coupled to assembled tent 102 along or adjacent to foot side 174 such that the ground-contacting ends 116 of the leg poles 164 that form head side 172 may be utilized as fulcrum ends 118. More specifically, supporting assembled tent 102 on the ground-contacting ends 116 of the longer leg poles 164 in canopy configuration 204 may increase the clearance and/or stability of assembled tent 102 in canopy configuration 204. As yet a more specific example, and as perhaps best seen in FIG. 6, outer tent fabric 108 may include a head side panel 186 that extends along head side 172 of assembled tent 102 and a foot side panel 188 that extends along foot side 174 of assembled tent 102. Lift couplers 112 may be attached to foot side panel 188, such as for examples in which the pair of leg poles 164 that define head side 172 are longer than the pair of leg poles 164 that define foot side 174.

Turning focus to FIG. 6, in canopy configuration 204, base 200 of assembled tent frame 106 is tilted relative to support surface 250 such that inner space 110 is surrounded by outer tent fabric 108 and inner space 110 is open or accessible through base 200. Tent 100 includes a pair of spaced-apart lift couplers 112 that are attached to outer tent fabric 108 along foot side 174 of assembled tent 102. More specifically, lift couplers 112 are attached to outer tent fabric 108 adjacent to the base region of two seams 126 that surround panel 124 of outer tent fabric 108 that extends along foot side 174. Each lift coupler 112 is received on the upper end region of a corresponding tent-elevating support 252, and the other end of each tent-elevating support 252 is engaged with support surface 250. Each lift coupler 112 also is engaged with one end of a corresponding guy line 122 that is anchored at the other end to support surface 250 by a ground anchor 162. Two leg poles 164 that define head side 172 of assembled tent 102 form fulcrum ends 118 that directly support assembled tent 102 on support surface 250. Tent 100 further includes two additional guy lines 122 that are coupled to outer tent fabric 108 along lateral sides 175 of assembled tent 102 and that are anchored to support surface 250 outside of base 200 by ground anchors 162 to tension outer tent fabric 108 outwardly such that outer tent fabric 108 surrounds a larger inner space 110. In some examples, tents 100 comprise two guy line couplers 138 that operatively couple these guy lines 122 to outer tent fabric 108, such as discussed herein. These guy line couplers 138 may be attached to outer tent fabric 108 adjacent to outer tent fabric doors 182. While outer tent fabric doors 182 are illustrated in FIG. 6 as being closed, it should be understood that either or both outer tent fabric doors 182 may be selectively opened, and optionally secured open, in canopy configuration 204.

Figure 7:
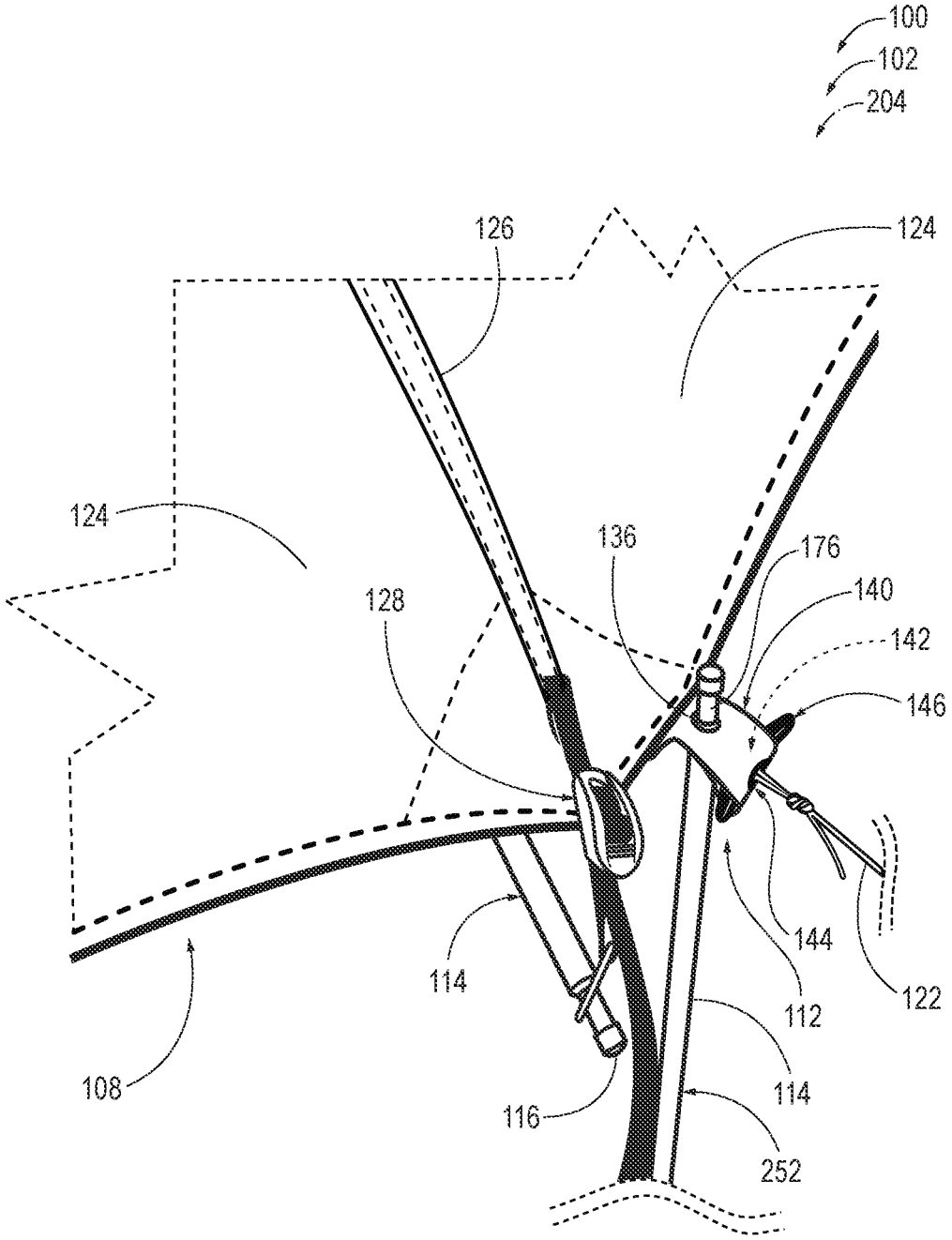
FIG. 7 is a less schematic partial view of a tent showing an example lift coupler according to the present disclosure.

Turning to FIG. 7, illustrated therein is a partial view showing a less-schematic example of lift coupler 112 of assembled tent 102 in canopy configuration 204. In this example, lift coupler 112 is attached to outer tent fabric 108. Outer tent fabric 108 includes adjacent panels 124 that are bound to one another along seam 126. Tent frame coupler 128 is attached to the base region of seam 126 and selectively interconnected with ground-contacting end 116 of tent pole 114. Lift coupler 112 is attached to outer tent fabric 108 along one of the panels 124 adjacent to the base of seam 126, but lift coupler 112 is spaced apart from tent frame coupler 128. In other words, tent frame coupler 128 and lift coupler 112 are attached to outer tent fabric 108 separately from one another. Lift coupler 112 may be offset towards the center of panel 124 so that tent pole 114 does not interfere with operation of lift coupler 112. Lift coupler 112 includes sling 140 that is directly attached to outer tent fabric 108, and elevating support receiver 136 comprises a grommet disposed centrally along sling 140. In this example, tent-elevating support 252 includes a tent pole 114 that extends upwardly from support surface 250 separately from assembled tent frame 106, and elevating support receiver 136 is engaged with, and resting upon, a cylindrical recess 176 formed along the upper end region of tent pole 114. Lift coupler 112 further includes guy line anchor 146 that is coupled to guy line 122 and operably received in interior channel 142 of sling 140 such that guy line 122 extends outwardly from slot 144. Further shown, elevating support receiver 136 is positioned along sling 140 inside of guy line anchor 146 such that guy line 122 applies a downward force to the top of tent-elevating support 252.

Figure 9:
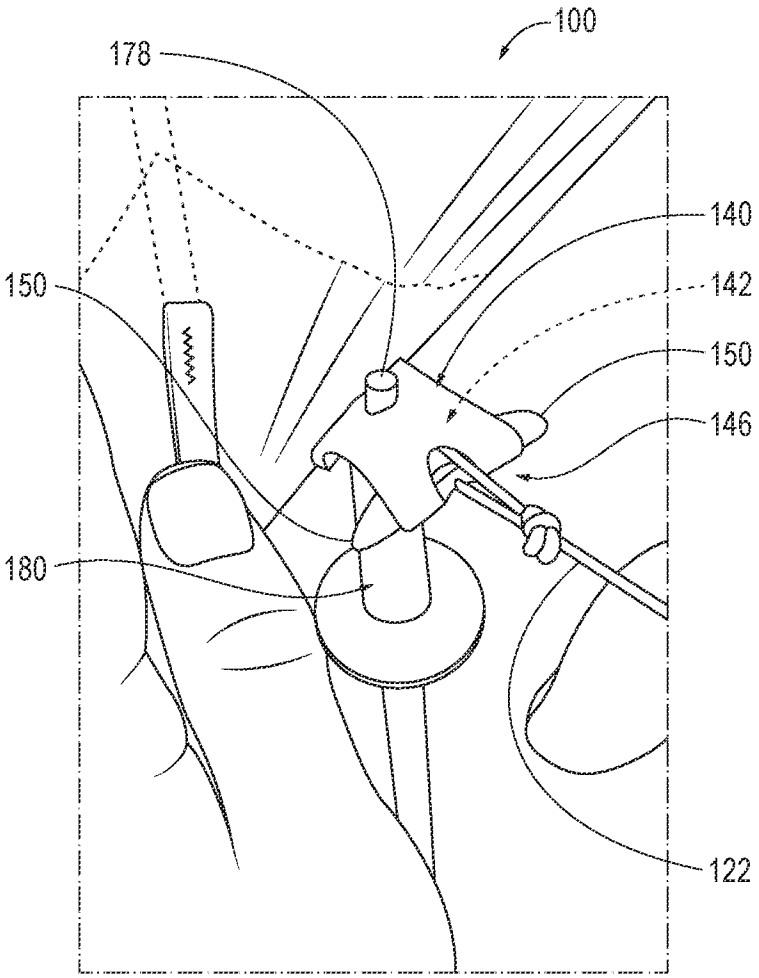
FIG. 9 is another less schematic partial view showing the guy line interconnected to the example lift coupler of FIG. 8.
Figure 8:
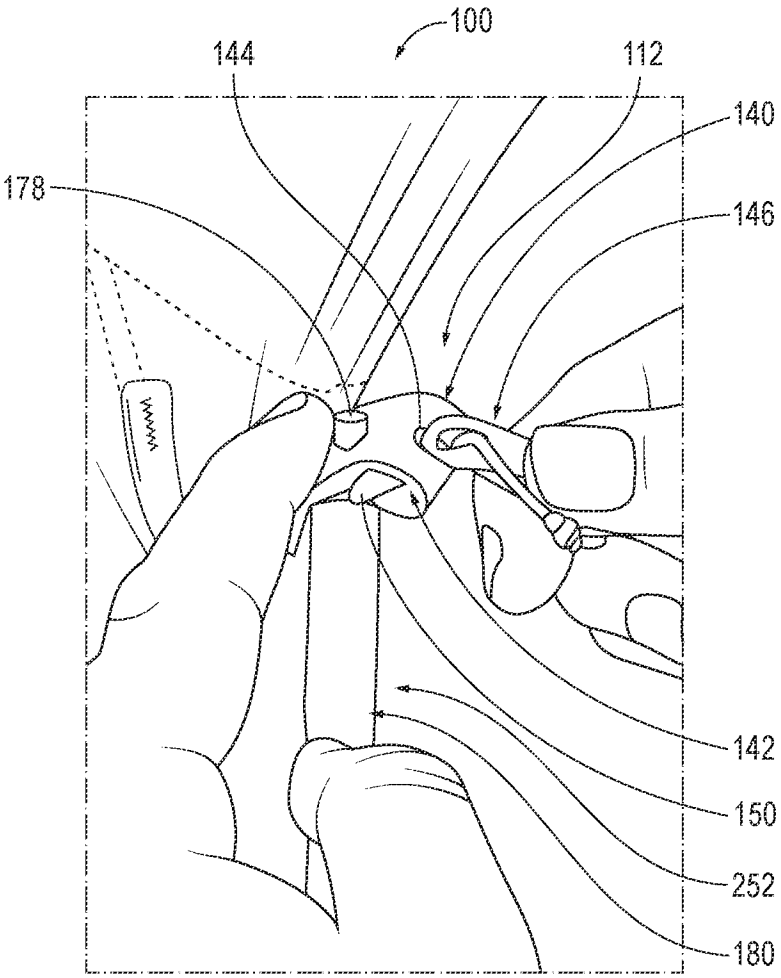
FIG. 8 is a less schematic partial view showing a user interconnecting a guy line to an example lift coupler of a tent according to the present disclosure.

FIGS. 8 and 9 are partial views of an example of tent 100 showing an example of a user connecting guy line 122 to lift coupler 112 via sling 140 and guy line anchor 146. With initial reference to FIG. 8, to insert guy line anchor 146 into interior channel 142 of sling 140, the user inserts one of the pair of projections 150 of guy line anchor 146 into slot 144 and moves projection 150 through interior channel 142 such that it protrudes from an open lateral side of interior channel 142. Once in this position, the user may manipulate sling 140 to bring the other projection 150 into interior channel 142 via slot 144 such that projection 150 protrudes from the other open lateral side of interior channel 142, as shown in FIG. 9. In the example shown in FIGS. 8 and 9, tent-elevating support 252 is an inverted trekking pole 180, and lift coupler 112 is engaged with a pole tip 178 of inverted trekking pole 180 as the user inserts guy line anchor 146 into interior channel 142 of sling 140. However, this sequence is not required for all examples of the present disclosure, and lift coupler 112 alternatively may be engaged with guy line 122 before being engaged with tent-elevating support 252.

Figure 10:
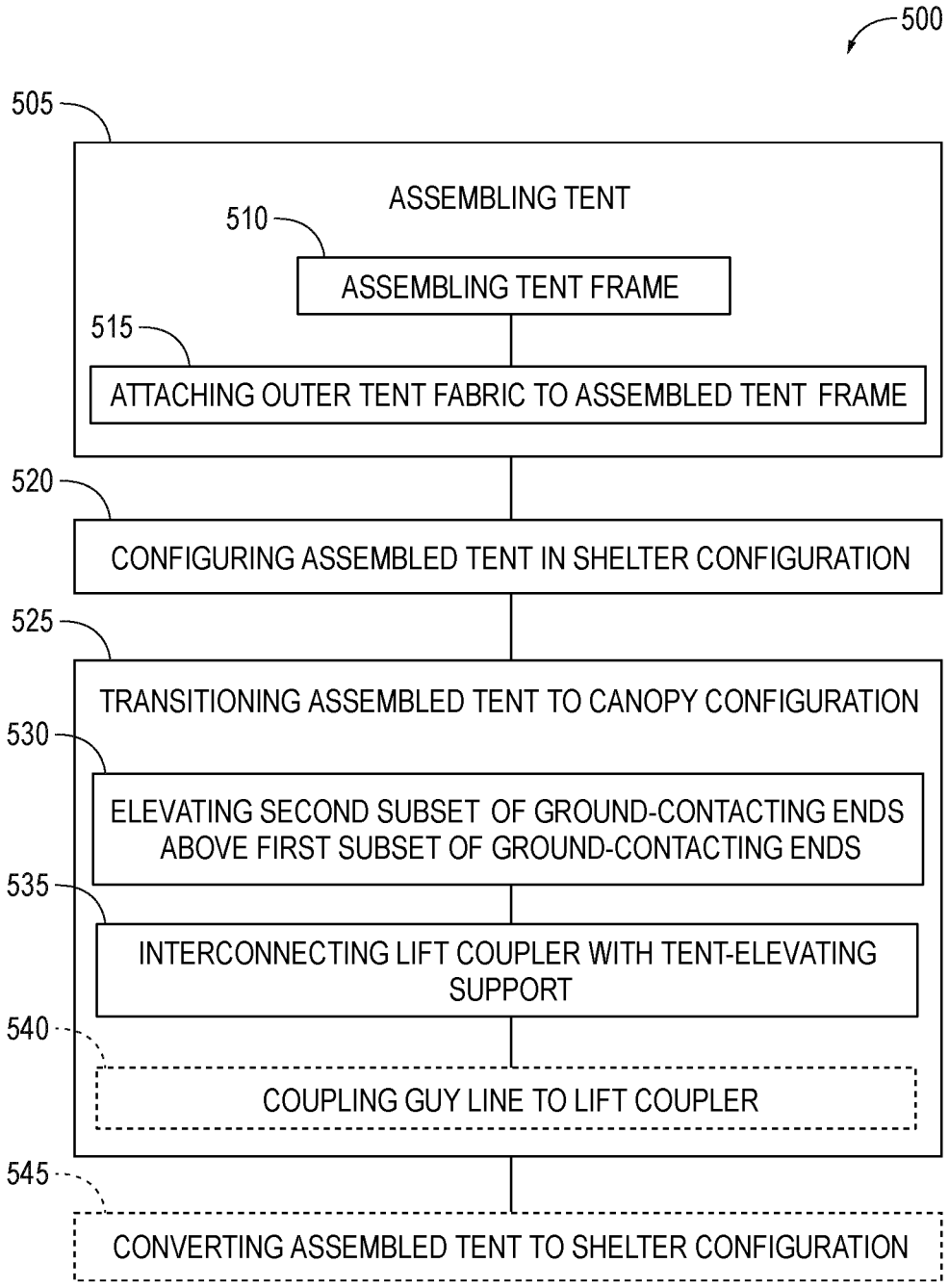
FIG. 10 is a flowchart schematically representing examples of methods according to the present disclosure.

FIG. 10 is a flowchart schematically representing examples of methods 500 according to the present disclosure. In FIG. 10, some steps are illustrated in dashed boxes, indicating that such steps are optional or correspond to an optional version of methods 500 according to the present disclosure. That said, not all methods 500 according to the present disclosure are required to comprise each of the steps illustrated in solid boxes. The methods and steps illustrated in FIG. 10 are non-limiting, and other methods and steps are within the scope of the present disclosure, including methods having greater than or fewer than the number of steps illustrated, as understood from the discussion herein.

Methods 500 comprise utilizing tents 100. Methods 500 may comprise utilizing the tents 100 that are illustrated and discussed herein with reference to FIGS. 1-9. That is, tents 100 illustrated and discussed herein with reference to FIGS. 1-9 may include any of the features, functions, properties, components, etc., as well as variants thereof, as those discussed herein with reference to methods 500 and FIG. 10 without requiring inclusion of all such features, functions, components, etc. Likewise, tents 100 discussed herein in connection to methods 500 and FIG. 10 may incorporate any of the features, functions, properties, components, etc., as well as variants thereof, as those discussed herein with reference to FIGS. 1-9 without requiring inclusion of all such features, functions, components, etc.

With reference to FIG. 10, methods 500 include assembling 505 a tent, which includes assembling 510 a tent frame, and attaching 515 an outer tent fabric to the assembled tent frame. Methods 500 further include configuring 520 the assembled tent in a shelter configuration, and transitioning 525 the assembled tent from the shelter configuration to a canopy configuration. The transitioning 525 includes elevating 530 a second subset of ground-contacting ends of the assembled tent frame above a first subset of ground-contacting ends of the assembled tent frame, and interconnecting 535 a lift coupler with a tent-elevating support. The transitioning 525 may include coupling 540 a guy line to the lift coupler. Methods 500 further may include converting 545 the assembled tent from the canopy configuration to the shelter configuration.

The assembling 505 includes assembling the tent as an assembled tent 102. The assembling may include assembling the tent 100 from a disassembled configuration, in which tent poles 114 of the tent frame 104 are at least partially disconnected from one another, as discussed herein. The outer tent fabric 108 and/or the inner tent fabric 120 also may be at least partially disconnected from tent frame 104 in the disassembled configuration. For examples in which the tent poles 114 of the tent frame are segmented, or include a plurality of segments, the pole segments of one or more tent poles may be at least partially disconnected from one another, and the pole segments optionally are arranged in a side-by-side relationship, as discussed herein. The assembling 505 may be performed prior to any other step of methods 500.

As shown in FIG. 10, the assembling 505 includes assembling 510 the tent frame to form an assembled tent frame that includes a plurality of ground-contacting ends and that defines a base between the ground-contacting ends. The assembling 510 may include interconnecting a plurality of tent poles 114 to one another, as discussed herein. The assembling 510 also may include connecting the segments of each segmented tent pole 114 in an end-to-end relationship, as discussed herein. More specifically, the assembling 510 may include interconnecting the tent poles 114 to one another such that at least some of the tent poles 114 form leg poles 164 that include the ground-contacting ends 116. The assembling 510 also may include interconnecting the tent poles 114 to one another such the tent poles 114 form a framework 107 that extends above and between the ground-contacting ends 116. The assembling 510 may be performed with any suitable sequence or timing within the assembling 505, such as prior to, or at least substantially simultaneously, with the attaching 515.

The assembling 505 also includes attaching 515 the outer tent fabric to the assembled tent frame such that the outer tent fabric surrounds an inner space that interfaces the base of the assembled tent frame. The attaching 515 may include attaching the outer tent fabric 108 to at least some of, and optionally each of, the ground-contacting ends 116 of the assembled tent frame 106, for example, via tent frame couplers 128 comprised in the outer tent fabric 108. The attaching 515 also may include attaching the outer tent fabric 108 to the assembled tent frame 106 such that the outer tent fabric extends between the ground-contacting ends 116 and/or such that the outer tent fabric 108 extends over an exterior of the assembled tent frame 106.

In some examples, the assembled tent frame 106 is a free-standing tent frame, in that the assembled tent frame forms a free-standing structure without being attached to the outer tent fabric 108 and/or inner tent fabric 120. In such examples, the attaching 515 may be performed subsequent to the assembling 510. In other examples, the attaching 515 is performed as a portion of the assembling 510. More specifically, the attaching 515 may include tensioning the tent frame 104 to form the assembled tent frame 106 and/or to form the framework 107 that extends above the ground-contacting ends 116 thereof. In some examples, the assembling 510 comprises bringing the ground-contacting ends 116 towards one another, with the plurality of tent poles 114 attached to one another, and the attaching 515 includes maintaining the ground-contacting ends 116 at a predetermined separation from one another, such as against a resilient restoring force applied to the outer tent fabric 108 by the assembled tent frame 106. Additionally or alternatively, the tent 100 may include a ground tarp having tent frame couplers appropriately positioned to receive and maintain the ground-contacting ends 116 at the predetermined separation, and the assembling 510 includes receiving the ground-contacting ends 116 in the tent frame couplers of the ground tarp.

With continued reference to FIG. 10, methods 500 further include configuring 520 the assembled tent in a shelter configuration 202. The configuring 520 includes supporting the plurality of ground-contacting ends of the assembled tent frame on the support surface such that the base defined by the assembled tent frame extends along the support surface and such that the inner space surrounded by the outer tent fabric interfaces the support surface. In some examples, the configuring 520 includes attaching an inner tent fabric 120 to the assembled tent frame 106, such as discussed herein. More specifically, the attaching the inner tent fabric 120 may include hanging the inner tent fabric 120 from the assembled tent frame 106 and/or positioning the inner tent fabric 120 at least partially within the inner space 110 defined by the outer tent fabric 108. The attaching the inner tent fabric 120 also may be performed independently of the attaching 515 the outer tent fabric. The configuring 520 may be performed with any suitable sequence or timing within methods 500, such as subsequent to the assembling 510 and/or prior to the transitioning 525.

Methods 500 further include transitioning 525 the assembled tent from the shelter configuration to the canopy configuration. For examples in which the configuring 520 includes attaching the inner tent fabric 120 to the assembled tent frame 106, the transitioning 525 may include at least partially or completely detaching the inner tent fabric 120 from the assembled tent frame 106. In some examples, the assembling 510 includes assembling the tent frame 104 and/or supporting the outer tent fabric 108 on the assembled tent frame 106 such that the outer tent fabric 108 and/or the assembled tent frame 106 forms a predefined shape. In some such examples, the transitioning 525 comprises at least substantially maintaining the predefined shape of the outer tent fabric 108 and/or the assembled tent frame 106.

The transitioning 525 includes elevating 530 a second subset of the ground-contacting ends above a first subset of the ground-contacting ends such that the base of the assembled tent frame is inclined relative to the support surface and the inner space of the outer tent fabric is accessible through the base of the assembled tent frame. The transitioning 525 may include supporting the first subset of ground-contacting ends 116 on the support surface 250. The first subset of ground-contacting ends 116 may be or include a pair of fulcrum ends 118, and the transitioning 525 may include tilting the assembled tent frame 106 about the pair of fulcrum ends 118. In some examples, the elevating 530 includes inclining the base 200 of the assembled tent frame 106 to an incline angle 210 relative to the support surface 250, as discussed herein. The elevating 530 may be performed with any suitable sequence or timing within the transitioning 525, such as prior to or substantially simultaneously with the elevating 530.

The transitioning 525 further includes interconnecting 535 a lift coupler with a tent-elevating support to support the assembled tent in the canopy configuration. As discussed herein, the lift coupler 112 is operatively attached to the assembled tent 102. For example, the lift coupler 112 may be operatively attached to the outer tent fabric 108, as discussed herein. As a more specific example, the assembled tent frame 106 may include a pair of leg poles 164 that include the second subset of ground-contacting ends 116, the outer tent fabric 108 may include a panel that extends between the pair of leg poles 164, and the lift coupler 112 may be attached to the outer tent fabric 108 along or adjacent to the panel. As discussed herein, the panel may be a foot side panel 188 and/or the lift coupler 112 may be attached along the foot side 174 of the assembled tent 102.

The interconnecting 535 may include interconnecting the lift coupler 112 to any suitable tent-elevating support 252, more specific examples of which are disclosed herein. In some examples the tent-elevating support 252 is freestanding. Additionally or alternatively, the interconnecting 535 may include supporting the tent-elevating support on the support surface to extend in an upward orientation from the support surface 250 and/or maintaining the tent-elevating support 252 in the upward orientation at least in part by connection to the lift coupler 112. In some examples, the transitioning 525 comprises supporting the fulcrum ends 118 on a first support surface 254, and the interconnecting 535 includes interconnecting the lift coupler 112 with a tent-elevating support 252 that extends from a second support surface 256, where the first and second support surfaces may be at different heights relative to one another, as discussed herein. The interconnecting 535 may include receiving the tent-elevating support 252 in an elevating support receiver 136 of the lift coupler 112, as discussed herein.

The transitioning 525 further may include coupling 540 a guy line to the lift coupler. More specifically, the coupling 540 may include attaching a first end of the guy line 122 to the lift coupler 112 and anchoring a second end of the guy line 122 to a support body, for example, a rock, a vehicle, a tree, or the support surface 250. The coupling 540 may include applying a downward (i.e., towards the support surface 250) tension to the lift coupler 112, and/or the outer tent fabric 108, which in turn may apply a downward force to the tent-elevating support 252. The coupling 540 also may include anchoring the second end of the lift coupler 112 spaced outwardly from the assembled tent 102 or from the tent-elevating support 252 such that the guy line 122 applies an outward tension to the lift coupler 112 and/or the outer tent fabric 108.

In some examples, the transitioning 525 includes anchoring the assembled tent 102 and/or the outer tent fabric 108 to the support surface 250 at one or more locations other than the lift coupler 112. As a more specific example, the anchoring may include operatively coupling ground anchors 162, such as via guy lines 122, to the outer tent fabric 108 adjacent to the fulcrum ends 118 of the assembled tent 102, for example, to balance the outward tension applied to the outer tent fabric 108 by the lift coupler 112 and the corresponding guy line 122. The anchoring also may include anchoring lateral sides 145 of the outer tent fabric 108 outwardly from the base 200 of the assembled tent frame 102, for example via guy lines 122 and guy line couplers 138 comprised in the lateral sides 175 of the outer tent fabric 108, such as to increase a volume of a canopy region 260 beneath the outer tent fabric 108. The transitioning 525 further may include opening one or more outer tent fabric doors 182, such as prior to or subsequent to the anchoring, the elevating 530, the interconnecting 535, and/or the coupling 540.

The coupling 540 may include utilizing a guy line coupler 138 comprised in the lift coupler 112 to couple the guy line 122 to the lift coupler 112. More specifically, the lift coupler 112 may include a guy line anchor 146 attached to the guy line 122, and the lift coupler further may include a sling 140 attached to the outer tent fabric 108, as discussed herein. The coupling 540 may include inserting a pair of projections 150 of the guy line anchor 146 into a pair of channel portions 154 of the sling 140 through a slot 144 in a side of the sling 140, as discussed herein.

As discussed herein, in some examples, the assembled tent 102 may include a plurality of lift couplers 112. In such examples, the transitioning 525 may include performing the interconnecting 535 and/or the coupling 540 respective to at least some of, and optionally each, lift coupler 112. In particular, the transitioning 525 may include interconnecting 535 each lift coupler 112 to a respective tent-elevating support 252 and/or coupling 540 each lift coupler to a respective guy line 122, as discussed herein. As yet a more specific example, the interconnecting 535 may include interconnecting a first lift coupler 112 to a first tent-elevating support 252, and optionally a first guy line 122, and interconnecting a second lift coupler 112 to a second tent-elevating support 252, and optionally a second guy line 122, where the first and second lift couplers 112 may be attached to a common panel of the outer tent fabric 108 that extends between a pair of leg poles 164 that are opposite to the fulcrum ends 118, as discussed herein.

The transitioning 525 may be performed with any suitable sequence or timing within methods 500, such as subsequent to the configuring 520 and/or prior to the converting 545.

With continued reference to FIG. 10, methods 500 may include converting 545 the assembled tent from the canopy configuration to the shelter configuration. When included in methods 500, the converting 545 includes disconnecting the lift coupler 112 from the tent-elevating support 252 and lowering the second subset of ground-contacting ends 116 relative to the first subset of ground-contacting ends 116 such that the second subset of ground-contacting ends 116 are directly supported on the support surface 250. The lowering may be performed subsequent to the disconnecting. For examples in which the transitioning 525 includes the coupling 540, the converting 545 may include decoupling the guy line 122 from the lift coupler 112 and/or detaching the guy line 122 from the support body. For examples in which the transitioning 525 comprises utilizing a plurality of lift couplers 112, the converting 545 may include disconnecting each lift coupler 112 from the respective tent-elevating support 252 and/or from the respective guy line 122. The converting 545 also may include moving the assembled tent 102 away from the tent-elevating support (s) 252 and/or moving the tent-elevating support(s) 252 away from the assembled tent 102. The converting 545 also may include attaching the inner tent fabric 120 to the assembled tent frame 106, as discussed herein. The converting 545 may be performed subsequent to the transitioning 525.

In some examples, method 500 may include disassembling the assembled tent 102 into the disassembled configuration and optionally stowing the tent 100 in the disassembled configuration. In such examples, methods 500 may include disassembling the assembled tent 102 from the shelter configuration 202 or from the canopy configuration 204. While the present disclosure focuses on transitioning 525 the assembled tent 102 from the shelter configuration 202 to the canopy configuration 204, methods 500 additionally or alternatively may include assembling 510 the tent 100 directly into the canopy configuration 202.

Examples of tents 100, lift couplers 112, and methods 500 according to the present disclosure are presented in the following enumerated paragraphs:

A. A tent, comprising:

a tent frame that, when assembled, forms an assembled tent frame defining a base and configured to support an outer tent fabric above the base and support the tent on a support surface;

the outer tent fabric, wherein, when supported by the assembled tent frame, the outer tent fabric is configured to surround an inner space that interfaces the base of the assembled tent frame;

wherein the tent forms an assembled tent when the outer tent fabric is operably supported by the assembled tent frame;

wherein the assembled tent is configured to selectively interconvert between a shelter configuration and a canopy configuration, wherein the base of the assembled tent frame extends along the support surface and the inner space surrounded by the outer tent fabric interfaces the support surface in the shelter configuration, and wherein the base of the assembled tent frame is inclined relative to the support surface and the inner space surrounded by the outer tent fabric is accessible through the base of the assembled tent frame in the canopy configuration; and a lift coupler configured to selectively and operatively interconnect the assembled tent with a tent-elevating support to selectively support the assembled tent in the canopy configuration.

A1. The tent of paragraph A, wherein the assembled tent frame comprises a plurality of tent poles that collectively include a plurality of ground-contacting ends, wherein the plurality of ground-contacting ends engage the support surface in the shelter configuration, and wherein the base of assembled tent frame is defined by the plurality of ground-contacting ends.

A2. The tent of paragraph A1, wherein in the assembled tent, the outer tent fabric is operably coupled to at least some of, and optionally all of, the plurality of ground-contacting ends.

A3. The tent of paragraph A2, wherein the plurality of tent poles form a framework that extends above and between the plurality of ground-contacting ends, and wherein in the assembled tent, the at least some of the plurality of ground-contacting ends tension the outer tent fabric over the framework.

A4. The tent of any of paragraphs A1-A3, wherein a first subset of the plurality of ground-contacting ends engage the support surface in the canopy configuration, and wherein a second subset of the plurality of ground-contacting ends is supported spaced above the support surface in the canopy configuration.

A5. The tent of paragraph A4, wherein the first subset of the plurality of ground-contacting ends is positioned along an opposed side of the assembled tent from the second subset of the plurality of ground-contacting ends.

A6. The tent of any of paragraphs A4-A5, wherein the second subset of the plurality of ground-contacting ends is moved upwardly relative to the support surface to transition the assembled tent from the shelter configuration to the canopy configuration, and wherein the second subset of the plurality of ground-contacting ends is moved downwardly relative to the support surface to transition the assembled tent from the canopy configuration to the shelter configuration.

A7. The tent of any of paragraphs A4-A6, wherein the first subset of the plurality of ground-contacting ends defines a pair of fulcrum ends, and wherein the assembled tent frame is configured to pivot about the pair of fulcrum ends to interconvert between the shelter configuration and the canopy configuration.

A8. The tent of paragraph A7, wherein in the canopy configuration, the pair of fulcrum ends support a first portion of the assembled tent on the support surface and the lift coupler operably supports a second portion of the assembled tent on the support surface via the tent-elevating support.

A9. The tent of any of paragraphs A-A8, wherein the base of the assembled tent frame defines a closed geometric shape having a plurality of vertices at which the plurality of ground-contacting ends are respectively positioned and a plurality of base sides, each extending between two adjacent vertices of the plurality of vertices.

A10. The tent of paragraph A9, when depending from paragraph A7 wherein the pair of fulcrum ends are positioned at adjacent vertices of the plurality vertices, wherein the adjacent vertices are fulcrum vertices and a base side of the base that extends between the fulcrum vertices is a fulcrum base side, and wherein the assembled tent frame is configured to pivot about the fulcrum vertices to interconvert between the shelter configuration and the canopy configuration.

A11. The tent of any of paragraph A10, wherein the assembled tent comprises a plurality of tent sides, at least some of which being aligned with and extending upwardly from a/the base side of the plurality of base sides defined by the assembled tent frame.

A12. The tent of paragraph A11, wherein the lift coupler is positioned along or adjacent to a tent side of the plurality of tent sides that is opposed to the fulcrum base side of the base.

A13. The tent of any of paragraphs A7-A12, wherein the pair of fulcrum ends are one of a plurality of pairs of fulcrum ends, wherein the assembled tent is configured to selectively pivot independently about each pair of fulcrum ends of the plurality of pairs of fulcrum ends to interconvert between the shelter configuration and the canopy configuration.

A14. The tent of paragraph A13, wherein the lift coupler is one of a plurality of lift couplers, and wherein each lift coupler of the plurality of lift couplers is disposed along or adjacent to a tent side of a/the plurality of tent sides of the assembled tent frame that is opposed to a/the pair of fulcrum ends of the plurality of fulcrum ends.

A15. The tent of any of paragraphs A-A14, wherein the outer tent fabric is operably coupled to and extends over the assembled tent frame when the assembled tent is in the canopy configuration.

A16. The tent of any of paragraphs A-A15, wherein the base of the assembled tent frame forms an incline angle with the support surface in the canopy configuration, and wherein the incline angle is at least one of at least 15°, at least 20°, at least 23°, at least 25°, at least 27°, at least 30°, at least 33°, at least 35°, at least 45°, at least 50°, at least 55°, at most 20°, at most 23°, at most 25°, at most 27°, at most 30°, at most 35°, at most 40°, at most 45°, at most 50°, at most 55°, at most 60°, and/or at most 65°.

A17. The tent of any of paragraphs A-A16, wherein the outer tent fabric of the assembled tent is supported by the assembled tent frame to form a predefined shape, and wherein the predefined shape of the outer tent fabric in the canopy configuration is at least substantially the same as the predefined shape of the outer tent fabric in the shelter configuration.

A18. The tent of any of paragraphs A-A17, wherein the lift coupler comprises an elevating support receiver configured to selectively receive and engage the tent-elevating support.

A19. The tent of any of any of paragraphs A-A18, further comprising a plurality of guy lines each being configured to tension the assembled tent frame against one or more of the tent-elevating structure and the support surface, and wherein the lift coupler comprises a guy line coupler configured to selectively receive and engage a guy line of the plurality of guy lines.

A20. The tent of paragraph A19, wherein the guy line coupler comprises:

a sling that enfolds an interior channel and that includes a slot that extends through a side of the sling into a central region of the interior channel, wherein the sling is coupled to the outer tent fabric; and a guy line anchor configured to be selectively received in and removed from the interior channel via the slot, wherein the guy line anchor comprises a body forming a pair of projections and a guy-line-receiving region positioned between the pair of projections that is configured to couple to a guy line of the plurality of guy lines.

A21. The tent of paragraph A20, wherein the interior channel of the sling includes a pair of channel portions extending from either side of the slot, and wherein when the guy line anchor is operably received in the interior channel, the pair of projections of the guy line anchor are respectively positioned within the pair of channel portions and engage the sling.

A22. The tent of any of paragraphs A20-A21, wherein the pair of projections extend at an angle relative to one another, and wherein the guy-line-receiving region is configured to orient a/the guy line to extend from an interior of the angle formed by the pair of projections.

A23. The tent of any of paragraphs A20-A22, wherein the guy line anchor positions a/the guy line to extend outwardly through the slot when the guy line anchor is operably positioned within the interior channel of the sling.

A24. The tent of any of paragraphs A20-A23, wherein lateral sides of the interior channel of the sling are open, and wherein the pair of projections of the guy line anchor protrude out of the lateral sides of the interior channel.

A25. The tent of any of paragraphs A20-A24, wherein a/the elevating support receiver is positioned along the sling nearer to the outer tent fabric than the interior channel.

A26. The tent of any of paragraphs A20-A25, wherein the sling is formed of one or more of a flexible material, a resilient material, fabric, fabric webbing, a strap, and a folded strap.

A27. The tent of any of paragraphs A-A26, wherein the lift coupler is coupled to the outer tent fabric.

A28. The tent of paragraph A27, wherein the outer tent fabric comprises a plurality of panels and a plurality of seams that interconnect the plurality of panels with one another, and wherein the lift coupler is coupled to the outer tent fabric along or adjacent to a base region of a seam of the plurality of seams.

A29. The tent of any of paragraphs A27-A28, wherein the outer tent fabric comprises a plurality of tent frame couplers each being configured to operably couple the outer tent fabric to a ground-contacting end of the plurality of the ground-contacting ends, and wherein the lift coupler is coupled to the outer tent fabric adjacent to and separately from a tent frame coupler of the plurality of tent frame couplers.

A30. The tent of any of paragraphs A-A29, wherein the lift coupler is one of a/the plurality of lift couplers.

A31. The tent of paragraph A30, wherein each lift coupler is configured to interconnect the assembled tent with a respective tent-elevating support.

A32. The tent of paragraph A30, when depending from paragraph A28, wherein a panel of the plurality of panels is bounded along two edges by a pair of seams of the plurality of seams, wherein the plurality of lift couplers comprises a pair of lift couplers, each being coupled to the outer tent fabric along or adjacent to a base region of a seam of the pair of seams.

A33. The tent of paragraph A32, wherein the pair of lift couplers are configured to operatively interconnect the assembled tent with a pair of respective tent-elevating supports.

A34. The tent of any of paragraphs A30-A33, wherein each lift coupler of the plurality of lift couplers is configured to selectively and operably interconnect the assembled tent with a respective tent-elevating support to support the assembled tent frame in the canopy configuration.

A35. The tent of any of paragraphs A-A34, wherein the outer tent fabric comprises one or more outer tent fabric doors that are configured to be selectively opened to provide access to the inner space when the assembled tent is in the shelter configuration and when the assembled tent is in the canopy configuration.

A36. The tent of any of paragraphs A-A35, wherein the assembled tent includes a head side, a foot side opposed to the head side, and lateral sides that extend between the head side and the foot side.

A37. The tent of paragraph A36, wherein a/the one or more outer tent fabric doors are positioned along the lateral sides of the assembled tent.

A38. The tent of any of paragraphs A-A37, wherein the assembled tent frame includes a first pair of leg poles that define the head side and a second pair of leg poles that define the foot side, wherein the first pair of leg poles are longer than the second pair of leg poles, and wherein the lift coupler is operatively coupled to the assembled tent along or adjacent to the foot side.

A39. The tent of paragraph A38, wherein the outer tent fabric includes a foot side panel that extends between the second pair of leg poles in the assembled tent, and wherein the lift coupler is attached to the outer tent fabric along or adjacent to the foot side panel.

A40. The tent of any of paragraphs A-A39, wherein the tent-elevating support includes one or more of a tree, a vehicle, a pole, and a branch.

A41. The tent of any of paragraphs A-A39, wherein the tent-elevating support includes an inverted trekking pole, and wherein a/the elevating support receiver of the lift coupler is configured selectively receive a pole tip of the inverted trekking pole.

A42. The tent of any of paragraphs A-A41, wherein the tent-elevating support has a height of at least 100 centimeters (cm), at least 120 cm, at least 130 at least 140 cm, at least 150 cm, at least 175 cm, at most 130 cm, at most 140 cm, at most 150 cm, at most 160 cm, at most 170 cm, at most 180 cm, and/or at most 190 cm.

A43. The tent of any of paragraphs A-A42, further comprising an inner tent fabric configured to selectively couple to the assembled tent frame to surround an inner tent space.

A44. The tent of paragraph A43, wherein the inner tent fabric is configured to selectively enclose the inner tent space when coupled to the assembled tent frame.

A45. The tent of any of paragraphs A43-A44, wherein inner tent fabric is configured to be hung from an underside of the assembled tent frame.

A46. The tent of any of paragraphs A43-A45, wherein the inner tent fabric comprises an inner tent fabric floor and a plurality of inner tent walls that extend upwardly from the inner tent floor, and wherein the inner tent floor and the plurality of inner tent walls are configured to selectively enclose the inner tent space.

A47. The tent of any of paragraphs A43-A46, wherein the inner tent fabric and the outer tent fabric are configured to selectively couple to and decouple from the assembled tent frame independently of one another.

A48. The tent of any of paragraphs A-A47, wherein the assembled tent frame is a freestanding assembled tent frame.

B. The assembled tent of any of paragraphs A-A48.

C. The lift coupler of any of paragraphs A-A48.

D. The use of the lift couplers of any of paragraphs A-A48 or C and at least one tent-elevating support of any of paragraphs A-A48 to selectively configure the assembled tent from the shelter configuration to the canopy configuration of any of paragraphs A-A48.

E. A method of utilizing a tent, the method comprising:

assembling the tent as an assembled tent, wherein the assembling comprises:

assembling a tent frame to form an assembled tent frame that defines a base between a plurality of ground-contacting ends of the assembled tent frame;

attaching an outer tent fabric to the assembled tent frame such that the outer tent fabric surrounds an inner space that interfaces the base of the assembled tent frame;

configuring the assembled tent in a shelter configuration, wherein the configuring comprises supporting the plurality of ground-contacting ends of the assembled tent frame on a support surface such that the base of the assembled tent frame extends along the support surface and the inner space surrounded by the outer tent fabric interfaces the support surface; and transitioning the assembled tent from the shelter configuration to a canopy configuration, wherein the transitioning comprises:

elevating a second subset of the plurality of ground-contacting ends above a first subset of the plurality of ground-contacting ends such that the base of the assembled tent frame is inclined relative to the support surface and the inner space is accessible through the base of the assembled tent frame; and interconnecting a lift coupler with a tent-elevating support to support the assembled tent in the canopy configuration, wherein the lift coupler is operatively attached to the assembled tent.

E1. The method of paragraph E, wherein the first subset of the plurality of ground-contacting ends are a pair of fulcrum ends that are opposed to the first subset of ground-contacting ends, and wherein the transitioning comprises supporting the pair of fulcrum ends on the support surface.

E2. The method of any of paragraphs E-E1, wherein the transitioning further comprises tilting the assembled tent frame about the pair of fulcrum ends.

E3. The method of any of paragraphs E-E2, wherein the assembling the tent comprises supporting the outer tent fabric on the assembled tent frame such that the outer tent fabric forms a predefined shape, and wherein the transitioning comprises at least substantially maintaining the predefined shape of the outer tent fabric.

E4. The method of any of paragraphs E-E3, wherein the interconnecting comprises receiving the tent-elevating support in an elevating support receiver of the lift coupler.

E5. The method of any of paragraphs E-E4, wherein the interconnecting further comprises coupling a guy line to the lift coupler and securing the guy line to the support surface.

E6. The method of paragraph E5, wherein the securing comprises applying downward tension to the outer tent fabric and/or the tent-elevating support with the guy line.

E7. The method of any of paragraphs E5-E6, wherein the lift coupler comprises a guy line anchor attached to the guy line and a sling attached to the outer tent fabric, and wherein the coupling comprises inserting a pair of projections of the guy line anchor into a pair of channel portions of the sling through a slot in a side of the sling.

E8. The method of any of paragraph E-E7, wherein the transitioning comprises supporting the tent-elevating support on the support surface to extend in an upward orientation from the support surface.

E9. The method of paragraph E8, when depending from paragraph E6, wherein the securing comprises tensioning the lift coupler against the tent-elevating support to maintain the tent-elevating support in the upward orientation.

E10. The method of any of paragraphs E-E9, wherein the assembled tent frame includes a pair of leg poles that include the second subset of ground-contacting ends, wherein the outer tent fabric includes a panel that extends between the pair of leg poles, and wherein the lift coupler is attached to the outer tent fabric along or adjacent to the panel.

E11. The method of any of paragraphs E-E10, wherein the lift coupler is one of a plurality of lift couplers, and wherein the interconnecting comprises interconnecting the plurality of lift couplers with a respective plurality of tent-elevating supports.

E12. The method of paragraph E11, when depending from paragraph E10, wherein the plurality of lift couplers includes a first lift coupler attached to the panel of the outer tent fabric proximate to a first of the pair of leg poles, and a second lift coupler attached to the outer tent fabric proximate to a second of the pair of leg poles.

E13. The method of any of paragraphs E-E12, further comprising converting the assembled tent from the canopy configuration to the shelter configuration, wherein the converting comprises:

disconnecting the lift coupler from the tent-elevating support; and lowering the second subset of ground-contacting ends such that the subset of ground-contacting ends are supported on the ground surface.

E14. The method of paragraph E13, when depending from paragraph E7, wherein the converting comprises decoupling the guy line from the lift coupler.

E15. The method of any of paragraphs E-E14, wherein the tent is the tent of any of paragraphs A-A48.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, "selective" and "selectively," when modifying an action, movement, configuration, or other activity of one or more components or characteristics of a tent according to the present disclosure, means that the specified action, movement, configuration, or other activity is a direct or indirect result of user manipulation of an aspect of, or one or more components of, the tent.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It also is within the scope of the present disclosure that elements, components, and/or other recited subject matter that is recited as being adapted to perform a particular function may additionally or alternatively be described as being configured to perform that function, and vice versa.

As used herein, "at least substantially," when modifying a degree or relationship, includes not only the recited "substantial" degree or relationship, but also the full extent of the recited degree or relationship. A substantial amount of a recited degree or relationship may include at least 75% of the recited degree or relationship. For example, an object that is at least substantially formed from a material includes an object for which at least 75% of the object is formed from the material and also includes an object that is completely formed from the material. As another example, a first direction that is at least substantially parallel to a second direction includes a first direction that forms an angle with respect to the second direction that is at most 22.5 degrees and also includes a first direction that is exactly parallel to the second direction. As another example, a first length that is substantially equal to a second length includes a first length that is at least 75% of the second length, a first length that is equal to the second length, and a first length that exceeds the second length such that the second length is at least 75% of the first length.

INDUSTRIAL APPLICABILITY

The tents, tent components, and methods disclosed herein are applicable to the outdoor products and tent industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, when the disclosure, the preceding numbered paragraphs, or subsequently filed claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A tent, comprising:

a tent frame that, when assembled, forms an assembled tent frame defining a base and configured to support an outer tent fabric above the base and support the tent on a support surface;

the outer tent fabric, wherein, when supported by the assembled tent frame, the outer tent fabric is configured to surround an inner space that interfaces the base of the assembled tent frame;

wherein the tent forms an assembled tent when the outer tent fabric is operably supported by the assembled tent frame;

wherein the assembled tent is configured to selectively interconvert between a shelter configuration and a canopy configuration, wherein the base of the assembled tent frame extends along the support surface and the inner space surrounded by the outer tent fabric interfaces the support surface in the shelter configuration, and wherein the base of the assembled tent frame is inclined relative to the support surface and the inner space surrounded by the outer tent fabric is accessible through the base of the assembled tent frame in the canopy configuration; and a lift coupler configured to selectively and operatively interconnect the assembled tent with a tent-elevating support to selectively support the assembled tent in the canopy configuration.

2. The tent of claim 1, wherein the assembled tent frame comprises a plurality of tent poles that collectively include a plurality of ground-contacting ends, wherein the plurality of ground-contacting ends engage the support surface in the shelter configuration, and wherein the base of assembled tent frame is defined by the plurality of ground-contacting ends.

3. The tent of claim 2, wherein in the assembled tent, the outer tent fabric is operably coupled to each ground-contacting end of the plurality of ground-contacting ends.

4. The tent of claim 2, wherein a first subset of the plurality of ground-contacting ends engage the support surface in the canopy configuration, and wherein a second subset of the plurality of ground-contacting ends is supported spaced above the support surface in the canopy configuration.

5. The tent of claim 4, wherein the first subset of the plurality of ground-contacting ends defines a pair of fulcrum ends, and wherein the assembled tent frame is configured to pivot about the pair of fulcrum ends to interconvert between the shelter configuration and the canopy configuration.

6. The tent of claim 5, wherein the pair of fulcrum ends define therebetween a fulcrum base side of the base of the assembled tent frame, and wherein the lift coupler is positioned along or adjacent to a tent side of the assembled tent that is opposed to fulcrum base side.

7. The tent of claim 1, wherein the outer tent fabric is operably coupled to and extends over the assembled tent frame when the assembled tent is in the canopy configuration.

8. The tent of claim 1, wherein the base of the assembled tent frame forms an incline angle with the support surface in the canopy configuration, and wherein the incline angle is at least 25° and at most 50°.

9. The tent of claim 1, wherein the outer tent fabric of the assembled tent is supported by the assembled tent frame to form a predefined shape, and wherein the predefined shape of the outer tent fabric in the canopy configuration is at least substantially the same as the predefined shape of the outer tent fabric in the shelter configuration.

10. The tent of claim 1, further comprising a plurality of guy lines each being configured to tension the assembled tent frame against one or more of the tent-elevating support and the support surface, and wherein the lift coupler comprises a guy line coupler configured to selectively receive and engage a guy line of the plurality of guy lines.

11. The tent of claim 1, wherein the lift coupler comprises a guy line coupler configured to selectively receive and engage a guy line, and wherein the guy line coupler comprises:

a sling that is coupled to the outer tent fabric, wherein the sling enfolds an interior channel and includes a slot that extends through a side of the sling into a central region of the interior channel; and a guy line anchor configured to be selectively received in and removed from the interior channel via the slot, wherein the guy line anchor comprises a body forming a pair of projections and a guy-line-receiving region positioned between the pair of projections that is configured to couple to the guy line.

12. The tent of claim 11, wherein the lift coupler further comprises an elevating support receiver configured to selectively receive and engage the tent-elevating support.

13. The tent of claim 11, wherein the interior channel of the sling includes a pair of channel portions extending from either side of the slot, and wherein when the guy line anchor is operably received in the interior channel, the pair of projections of the guy line anchor are respectively positioned within the pair of channel portions and engage the sling.

14. The tent of claim 1, wherein the lift coupler is one of a plurality of lift couplers, and wherein each lift coupler is configured to interconnect the assembled tent with a respective tent-elevating support in the canopy configuration.

15. The tent of claim 1, wherein the outer tent fabric includes one or more outer tent fabric doors that are configured to be selectively opened to provide access to the inner space when the assembled tent is in the shelter configuration and when the assembled tent is in the canopy configuration.

16. The tent of claim 1, wherein the assembled tent includes a head side, a foot side opposed to the head side, and lateral sides that extend between the head side and the foot side, wherein the assembled tent frame includes a first pair of leg poles that define the head side and a second pair of leg poles that define the foot side, wherein the first pair of leg poles are longer than the second pair of leg poles, and wherein the lift coupler is operatively coupled to the assembled tent along or adjacent to the foot side.

17. The tent of claim 16, wherein the outer tent fabric includes a foot side panel that extends between the second pair of leg poles in the assembled tent, and wherein the lift coupler is attached to the outer tent fabric along or adjacent to the foot side panel.

18. The tent of claim 1, further comprising an inner tent fabric configured to selectively couple to the assembled tent frame to surround an inner tent space, wherein the inner tent fabric and the outer tent fabric are configured to selectively couple to and decouple from the assembled tent frame independently of one another.

19. The tent of claim 1, wherein the tent-elevating support has a height of at least 100 centimeters (cm) and at most 190 cm.

20. A method of utilizing a tent, the method comprising:

assembling the tent as an assembled tent, wherein the assembling comprises:

assembling a tent frame to form an assembled tent frame that defines a base between a plurality of ground-contacting ends of the assembled tent frame;

attaching an outer tent fabric to the assembled tent frame such that the outer tent fabric surrounds an inner space that interfaces the base of the assembled tent frame;

configuring the assembled tent in a shelter configuration, wherein the configuring comprises supporting the plurality of ground-contacting ends of the assembled tent frame on a support surface such that the base of the assembled tent frame extends along the support surface and the inner space surrounded by the outer tent fabric interfaces the support surface; and transitioning the assembled tent from the shelter configuration to a canopy configuration, wherein the transitioning comprises:

elevating a second subset of the plurality of ground-contacting ends above a first subset of the plurality of ground-contacting ends such that the base of the assembled tent frame is inclined relative to the support surface and the inner space is accessible through the base of the assembled tent frame; and interconnecting a lift coupler with a tent-elevating support to support the assembled tent in the canopy configuration, wherein the lift coupler is operatively attached to the assembled tent.

* * * * *